US011357704B2

(12) United States Patent
Duda et al.

(10) Patent No.: US 11,357,704 B2
(45) Date of Patent: Jun. 14, 2022

(54) PILL DISPENSERS, SYSTEMS AND/OR METHODS

(71) Applicant: GRAMedical LLC, Mountain View, CA (US)

(72) Inventors: W. Gregory Duda, Grass Valley, CA (US); Richard J. Freedland, Mountain View, CA (US); Alex Moraru, Aptos, CA (US); Milton R. Grinberg, Palo Alto, CA (US)

( * ) Notice: Subject to any disclaimer, the term of this patent is extended or adjusted under 35 U.S.C. 154(b) by 0 days.

(21) Appl. No.: 16/792,737

(22) Filed: Feb. 17, 2020

(65) Prior Publication Data

US 2020/0179229 A1 Jun. 11, 2020

Related U.S. Application Data

(63) Continuation of application No. 15/175,513, filed on Jun. 7, 2016, now Pat. No. 10,561,580.

(51) Int. Cl.

| | |
|---|---|
| ***A61J 7/00*** | (2006.01) |
| ***A61J 1/03*** | (2006.01) |
| ***B65D 83/04*** | (2006.01) |
| ***A61J 7/04*** | (2006.01) |
| ***A61J 1/00*** | (2006.01) |

(52) U.S. Cl.

CPC ..... *A61J 7/0084* (2013.01); *A61J 1/00* (2013.01); *A61J 1/03* (2013.01); *A61J 7/0418* (2015.05); *A61J 7/0427* (2015.05); *A61J 7/0454* (2015.05); *A61J 7/0481* (2013.01); *B65D 83/04* (2013.01)

(58) Field of Classification Search

CPC ..... A61J 7/0084; A61J 7/0418; A61J 7/0076; A61J 7/0427; A61J 7/0436; B65D 83/00; B65D 83/0409; B65D 83/0811; B65D 83/087; A47K 10/46; A47K 10/421; A47K 2010/3266; G07F 11/00; B65B 59/00

USPC ..... 221/12

See application file for complete search history.

(56) References Cited

U.S. PATENT DOCUMENTS

| | | | | |
|---|---|---|---|---|
| 3,276,636 A * | 10/1966 | Johnson, Jr. | ..... | B65D 83/0409 222/368 |
| 4,343,388 A | 8/1982 | DuBois et al. | | |
| 4,505,381 A * | 3/1985 | Major | ..... | B65G 47/261 198/781.02 |
| 4,677,283 A * | 6/1987 | Lewis | ..... | G06M 7/00 198/383 |

(Continued)

FOREIGN PATENT DOCUMENTS

| | | | | |
|---|---|---|---|---|
| EP | 1870072 A2 * | 12/2007 | ..... | A61J 7/0084 |

OTHER PUBLICATIONS

Supplementary European Search Report for Application No. EP17810871 issued by the European Patent Office, dated Dec. 13, 2019, 7 pages, EPO, Munich, Germany.

(Continued)

*Primary Examiner* — Rakesh Kumar

(74) *Attorney, Agent, or Firm* — Peter B. Scull; EIP US LLP

(57) ABSTRACT

Pill dispenser devices, systems and methods are shown and/or described herein. Include are a method, device or system for pill delivery including disposing a pill at a known location; contacting the pill with a pick-up member; and, moving the pill from the known location by movement of the pick-up member.

20 Claims, 20 Drawing Sheets

(56) References Cited

U.S. PATENT DOCUMENTS 5,317,645 A * 5/1994 Perozek ..... G06M 11/00 209/522
5,407,317 A * 4/1995 Pippin ..... B65G 1/1376 186/52
5,463,839 A * 11/1995 Stange ..... B65B 57/20 53/54
5,638,417 A * 6/1997 Boyer ..... A61J 7/02 377/6
5,671,262 A * 9/1997 Boyer ..... G06M 1/101 377/11
5,860,563 A * 1/1999 Guerra ..... G07F 9/002 221/172
6,053,302 A * 4/2000 Leu ..... A61J 7/02 198/471.1
6,378,858 B1 * 4/2002 Suga ..... B65H 3/0669 271/10.01
6,510,962 B1 * 1/2003 Lim ..... A61J 7/0481 221/15
6,742,671 B2 6/2004 Hebron et al.
7,004,353 B2 * 2/2006 Yamamoto ..... B65B 57/20 221/277
7,149,600 B2 * 12/2006 Rippolone ..... G06Q 10/087 700/237
7,264,136 B2 * 9/2007 Willoughby ..... B65D 75/42 221/13
7,359,765 B2 * 4/2008 Varvarelis ..... A61J 7/0481 700/237
7,922,167 B2 * 4/2011 Kajiyama ..... B65H 9/006 271/4.01
8,020,724 B2 9/2011 Remis et al.
8,083,078 B2 * 12/2011 Omura ..... G07F 17/0092 211/59.3
8,091,733 B2 1/2012 Janet et al.
8,108,068 B1 * 1/2012 Boucher ..... G01G 17/00 700/236
8,220,657 B2 * 7/2012 Cicognani ..... B65B 35/14 221/7
8,225,925 B2 * 7/2012 Bassani ..... B65B 5/08 198/758
8,392,020 B2 * 3/2013 Terzini ..... A61J 7/02 700/243
8,712,268 B2 * 4/2014 Iwasaki ..... G03G 15/2064 399/67
8,833,603 B1 9/2014 Balasubramanian et al.
9,296,545 B2 * 3/2016 Daniels ..... B65D 83/04
9,387,518 B2 7/2016 Deppermann
9,492,355 B2 * 11/2016 Ratnakar ..... G07F 9/02
9,501,626 B2 * 11/2016 Zhang ..... G16H 20/13
9,501,887 B2 11/2016 Berg et al.
9,542,534 B1 * 1/2017 Ducatt ..... G16H 20/13
9,984,213 B2 * 5/2018 Howieson ..... A61J 7/0409
10,224,116 B2 * 3/2019 Howieson ..... A61B 5/1172
10,457,473 B2 * 10/2019 Daniels ..... B65G 47/1492
2003/0024943 A1 * 2/2003 MacDonald ..... A61J 7/0084 221/92
2006/0006190 A1 * 1/2006 Janet ..... G07F 11/1657 221/211
2006/0071011 A1 * 4/2006 Varvarelis ..... G07F 17/0092 221/9
2009/0105876 A1 4/2009 Simpson et al.
2009/0112361 A1 4/2009 Berg
2009/0218363 A1 * 9/2009 Terzini ..... B65B 5/103 221/4
2009/0321470 A1 * 12/2009 Knoth ..... B65B 5/103 221/7
2010/0256808 A1 * 10/2010 Hui ..... G07F 11/1657 700/225
2010/0258405 A1 * 10/2010 Ackley ..... B65G 47/842 198/340
2011/0088810 A1 * 4/2011 Cicognani ..... B65B 5/103 141/192
2012/0072017 A1 * 3/2012 Kim ..... B65B 35/14 700/231
2014/0131378 A1 5/2014 Shih et al.
2014/0138398 A1 * 5/2014 Daniels ..... B65G 47/1492 221/1
2014/0353327 A1 * 12/2014 Bae ..... G07F 11/24 221/7
2014/0358278 A1 * 12/2014 Zhang ..... G16H 20/13 700/240
2015/0028050 A1 * 1/2015 Huang ..... B25J 9/1694 221/211
2015/0175287 A1 * 6/2015 Tidhar ..... B65B 57/14 700/240
2016/0247345 A1 * 8/2016 Ratnakar ..... A61J 7/0481
2017/0348194 A1 * 12/2017 Duda ..... A61J 7/0454
2017/0357775 A1 12/2017 Ekin
2019/0144195 A1 * 5/2019 Daniels ..... G07F 11/44 221/1
2020/0179229 A1 * 6/2020 Duda ..... A61J 7/0084

OTHER PUBLICATIONS

Melissa Rayworth, Caring for elderly parents from afar? Some tips, Associated Press News Release, Jun. 30, 2014, The Associated Press, New York, New York.

Joe Hage, Chronic Disease and the Internet of Things, LinkedIn Blog, Mar. 3, 2015, Medical Devices Group, a companion website to LinkedIn, Seattle, Washington.

CVS Health, Adherence, Why it's So Hard and What We Can Do About It, http://www.cvshealth.com/insights-adherence2014, CVS Insights Journal, Fall 2014 (the year of publication is sufficiently earlier than the effective U.S. filing date and any foreign priority date so that the particular month of publication is not in issue), p. 1-16, CVSHealth.com, New York, New York.

Pamela Yip, Gadgets improve the lives of seniors, Dallas Morning News, Aug. 17, 2014, pp. 1-5, Dallas Morning News, Incorporated, Dallas Morning News, Dallas, Texas.

Lisa Hartwell, Getting Control of Your Medication, Homecare California brochure, May 2016, p. 1, Homecare California, Incorporated, Los Altos, California.

Nathan Eddy, Home Medical Monitoring Device Market Shows Healthy Signs, eWeek website, http://www.eweek.com/print/it-management/home-medical-monitoring-device-market-shows-healthy-signs.html, Jun. 27, 2014, 2014 eWeek.com, Property of QuinStreet Enterprise Incorporated, Foster City, California.

Ilinois Register, Department on Aging, Notice of Proposed Amendments, Public Notification of Proposed Changes to State Mandates Concerning Medical Dispenser Devices for the Elderly, www.illinois.gov/aging, pp. 1435-1443, 2014 (the year of publication is sufficiently earlier than the effective U.S filing date and any foreign priority date so that the particular month of publication is not in issue), State of Illinois, Chicago, Illinois.

Bill Welch, Keeping the Patient at the Center of Drug Delivery Devices, Philips-Medsize Corporation brochure, Jan. 2016, pp. 1-5, Phillips Medisize Corporation, Cambridge, Massachusetts.

Report: Low Drug Adherence Costing Millions, PRNewswire report online, Jun. 27, 2013, pp. 1-5, http://www.cvscaremarkfyi.com, CVS Caremark Pharmacy Services, Lee's Summit, Missouri.

Marie T. Brown, MD. et al, Medication Adherence: Who Cares?, Mayo Clinic Proceedings, www.mayoclinicproceedings.com, Apr. 2011, pp. 304-314, vol. 86, Issue 4, Mayo Foundation for Medical Education and Research, Oak Park, Illinois.

Greg Slabodkin, "Medicalized" smartphones to put health data in hands of patients, http://www.healthdatamanagement.com/news/medicalized-smartphone.html, Jul. 1, 2016, p. 1, SourceMedia, New York, New York.

Andrew M. Seaman, Older Americans taking more medications, Reuters Health online article, Mar. 21, 2016, JAMA Internal Medicine, online, bit.ly/25giSwq, bit ly/25giTAs, bit.ly/25gj12O, Reuters, Canary Wharf, London, England.

Lois A. Bowers, OTC medications linked to cognitive impairment—again, http://www.mcknightsseniorliving.com/news/otc-medications-

(56) References Cited

OTHER PUBLICATIONS linked-to-cognitive-impairment.html, Apr. 22, 2016, pp. 1-2, Haymaker Media, Incorporated, Lake County, Illinois.
Liqun Liu, et al., The Rising Burden of Health Spending on Seniors, National Center for Policy Analysis online, http://www.ncpa.org/pub/st297, Feb. 1, 2007, pp. 1-3, vol. 297, National Center for Policy Analysis, Dallas, Texas.
U.S. Department of Health and Human Services, Food and Drug Administration, Center for Drug Evaluation and Research (CDER), Size, Shape, and Other Physical Attributes of Generic Tablets and Capsules, Guidance for Industry, http://www.fda.gov/Drugs/GuidanceComplianceRegulatoryInformation/Guidances/default.htm, Jun. 2015, Pharmaceutical Quality/CMC, pp. 1-10, Office of Communications, Division of Drug Information Center for Drug Evaluation and Research Food and Drug Administration, Silver Spring, Maryland.
Brian Fung, The $289 Billion Cost of Medication Compliance, and What to Do About It, The Atlantic magazine, http://www.theatlantic.com/health/archive/2012/09/the-289-billion-cost-of-medications-noncompliance-and-what-to-do-about-it/26222/, Sep. 11, 2012, pp. 1-3, The Atlantic Group, Washington, District of Columbia.
Home Care Association of America, Caring for America's Seniors: The Value of Home Care, Home Care Association of America brochure, Global Coalition on Aging, https://www.homeinstead.com/Documents/Better-Care-For-Seniors.pdf, Jul. 15, 2016, pp. 1-25, Home Care Association of America, Washington, District of Columbia.
Jack Young, Wearables in Healthcare, SMARTwear Symposium presentation, Jun. 24, 2014, pp. 1-28, Qualcomm Ventures, San Diego, California.
Ken Dychtwald, Ph.D., The Longevity Economy: Tomorrow's Biggest Opportunities are Hiding in Plain Sight, Silicon Valley Boomer Venture Summit presentation, Jul. 22, 2916, pp. 1-96, Age Wave Incorporated, Emeryville, California.
International Search Report (ISR) and Written Opinion, International Application No. PCT/US2017/036180, International Filing Date Jun. 6, 2017, ISR dated Aug. 29, 2017, 14 pages, USPTO, Alexandria, VA.
Notification Concerning Transmittal of International Preliminary Report of Patentability, dated Dec. 20, 2018, 1 page, International Bureau of WIPO, Geneva, Switzerland, and International Preliminary Report on Patentability for Application No. PCT/US2017/036180 issued by the International Bureau of WIPO, Geneva, Switzerland, dated Dec. 11, 2018, 1 page, which includes the Written Opinion of the ISA, International Application No. PCT/US2017/036180, International Filing Date Jun. 6, 2017, Date of Mailing of Written Opinion dated Aug. 29, 2017.

* cited by examiner

Flowchart

PILL DISPENSERS, SYSTEMS AND/OR METHODS

BACKGROUND

The present developments relate to automatic pill dispensers. In many implementations, these may particularly include and/or be directed to methods, systems and/or devices which may be programmed to automatically dispense predetermined quantities and/or pre-selected types of pills whether on demand or at preset times.

The usage of pills, both prescription drugs and supplements, to regain and/or maintain health has increased with the advancement of medical science. It is not unusual for a person to take more than one type of pill, or to have different regimens and timings for taking same. Often, each type of pill may be in a different amount, and though typically at regular times each day; some may be early, others late, some with food, some not, and so on. The task of correctly taking pills, often several different types of pills, regularly poses a challenge to many individuals, especially the elderly population living without full time medical care. The improper taking of pills can be detrimental to health resulting in emergency room visits, hospital admissions, re-location to nursing facilities and even sometimes death.

The need for devices, systems and/or methods that will provide for properly dispensing the proper pill(s) in the proper amount(s) at the proper time(s) each day is evident. Moreover, several possible/optional desiderata for further options of automations and programmability in dispensing and/or in alerting the user to take the dispensed pill(s) are also evident.

SUMMARY

Pill dispenser devices, systems and methods are shown and/or described herein. Include are a method, device or system for pill delivery including disposing a pill at a known location; contacting the pill with a pick-up member; and, moving the pill from the known location by movement of the pick-up member.

DETAILED DESCRIPTION

The presently-described subject matter may be configured to provide for dispensing proper amount(s) of proper type(s) of pill(s) at proper time(s).

In some implementations the subject matter hereof may provide for alerting a pill taker to consume the pills. In further possible implementations, the subject matter hereof may also include apparatuses and/or methods for notifying family members, caregivers, and/or medical professionals (e.g. in some instances these can include those professionals making, or in some situations those not making the change) when a change has been made to any pill regimen or dosage. This can be very helpful particularly for seniors and the elderly who may have more than one doctor or medical professional prescribing medication.

Figure 1A:
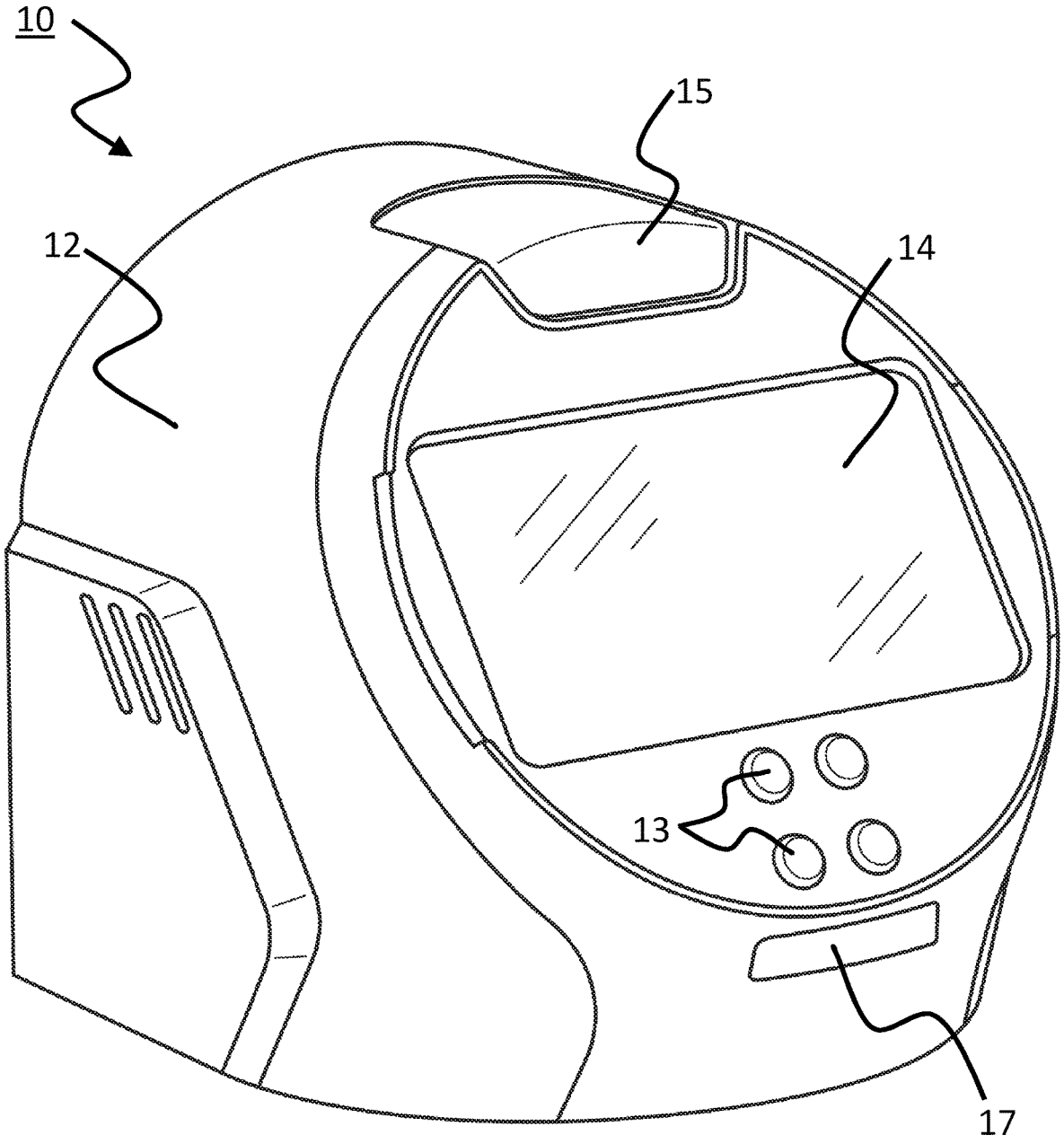
FIG. 1, which includes and is defined by sub-part FIGS. 1A, 1B and 1C, provides front isometric views of a pill dispenser hereof.
Figure 1B:
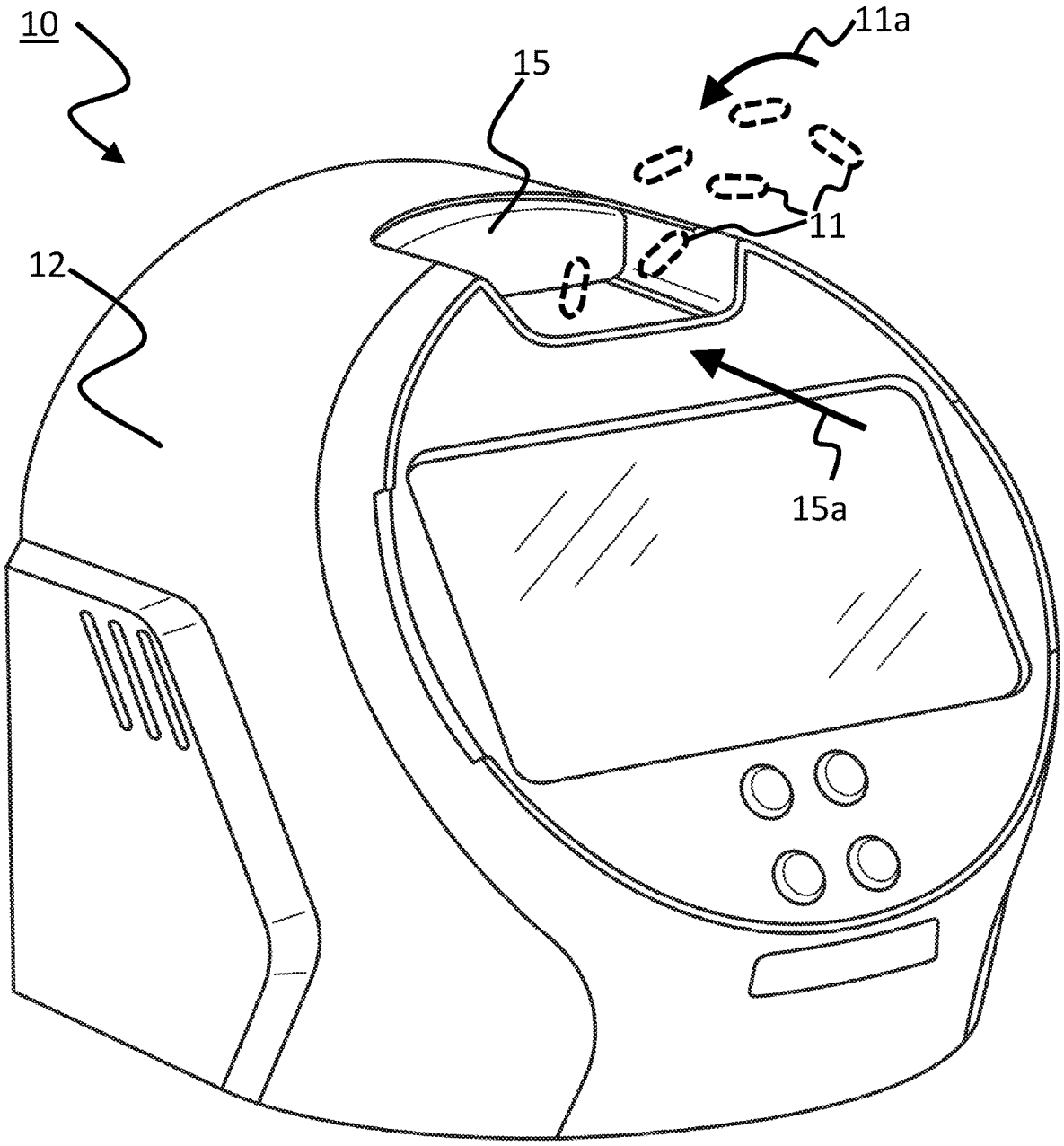
Figure 1C:
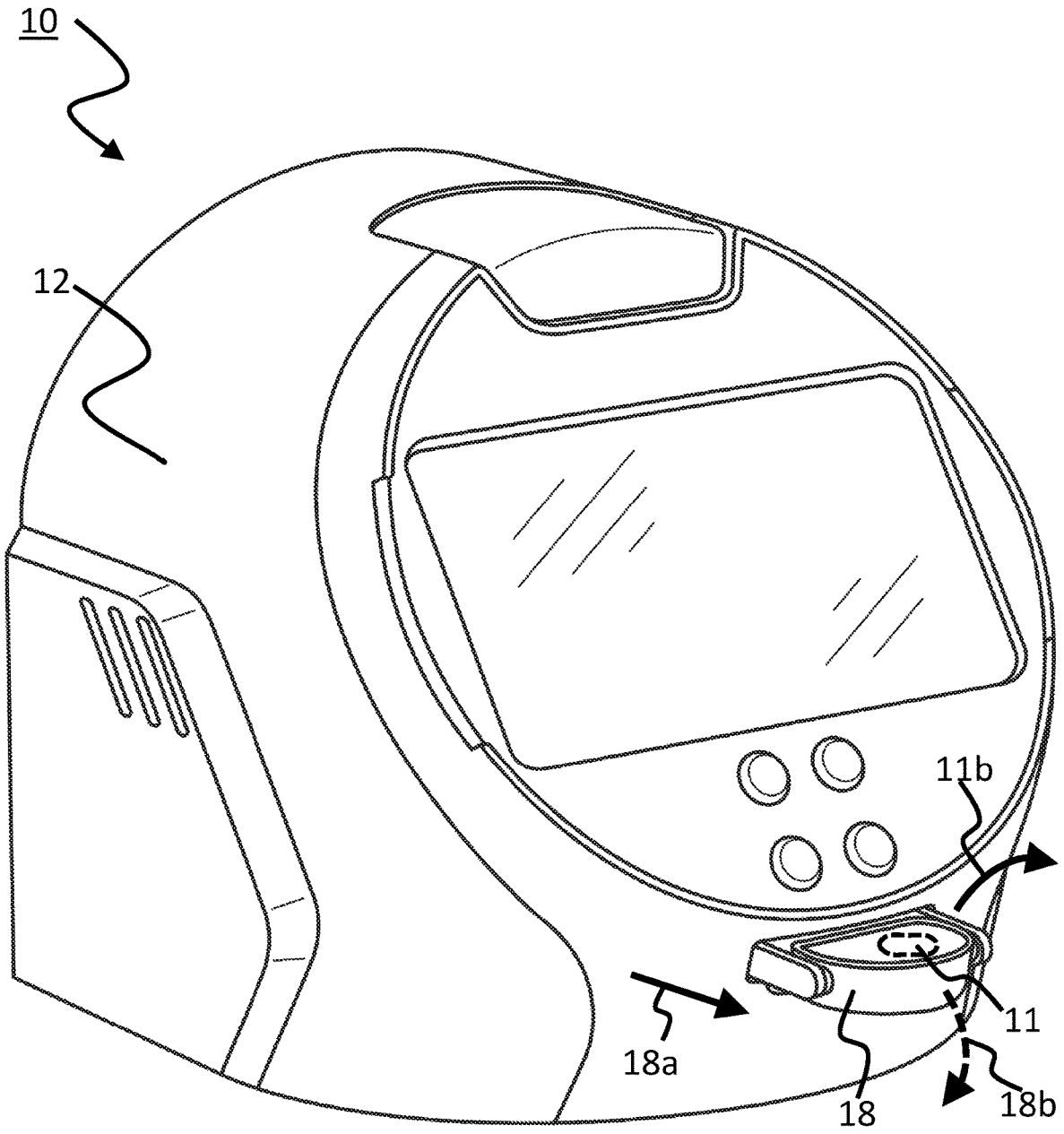

In accordance herewith, an isometric front view of a schematically-represented, alternative pill dispenser 10 according hereto is shown in FIG. 1, which is defined by and includes sub-part FIGS. 1A, 1B and 1C (reference to FIG. 1 includes one or more or all of the sub-part FIGS. 1A, 1B and/or 1C). Myriad other forms of pill dispensers may fit within the scope hereof with no requirement to be limited to the implementations shown, whether in FIG. 1 or otherwise; limited only by the proper scope of the claims appended hereto.

In some more particularity, the alternative implementation of FIG. 1 may include the following. For example, FIG. 1A shows a pill dispenser 10 including a housing 12 and a user interface 14, which may be a touchscreen or otherwise and/or may provide visually and/or aurally perceived communications to a user, and if a touchscreen or otherwise may receive communications from a user. A set of one or more buttons 13 may also/alternatively be provided for user interaction, input or the like, though again, same might be provided by touchscreen or other inputs, as for example from/through wireless or cabled communications, USB or Wi-Fi or otherwise (none of which here shown) to and/or from the device 10.

Further shown are respective openings 15 and 17 in and/or through the housing 12; represented here by a slidable door 15 and an aperture 17 that may also include a door (slidable or otherwise) or other covering. In the presently described and shown implementation of FIG. 1, inter alia, the door 15 is slidable toward the rear (as indicated by arrow 15*a*) to an open position as shown in FIG. 1B, to provide for ingress for one or more pills 11 (six exemplar pills 11 shown in dashed lines) (ingress, as indicated generally by arrow 11*a* in FIG. 1B). Such pills 11 are received within one or more particular bins 44 (not shown in FIG. 1, but see FIG. 2, et al.) as described further below.

Then, ultimately, per the operation of the device 10 (described further below), one or more pills 11 will be delivered to the user as shown by/in FIG. 1C. In FIG. 1C, shown is a movement of a pill cup 18 having a pill 11 (only one pill 11 shown in FIG. 1C) therein moved out translationally from the interior of the dispenser 10 (as represented by arrow 18*a*) ready for removal by a user (see arrow 11*b*). Note, the cup 18 may be, as shown in one interpretation of FIG. 1C, pivotally disposed to allow for optional tilting thereof (as shown by dashed line arrow 18*b*; down to the front for one option of an ultimate delivery).

Figure 2:
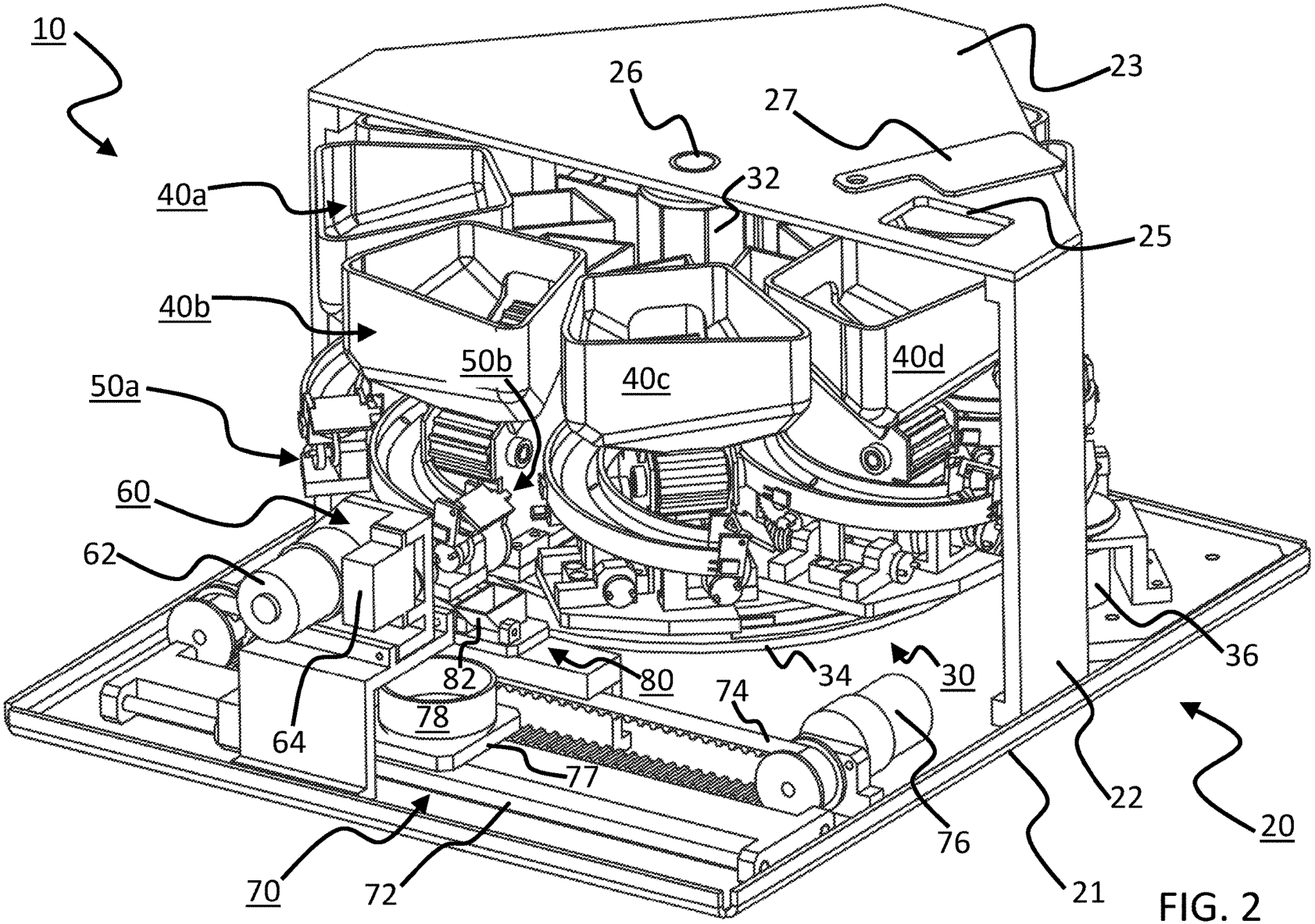
FIG. 2 provides a partially cut-away isometric view of many interior components of a pill dispenser according hereto.

A isometric view of many alternatively-implemented internal working components of a pill dispenser 10 hereof is shown in FIG. 2. FIG. 2 shows some of the major components of a pill dispenser 10 which may in this implementation, inter alia, include disposed in and operationally connected to a frame sub-assembly 20, an operationally rotationally movable sub-assemblage 30 on or to which is/are disposed one or more pill handling sub-assembly/ies 40; though shown in FIG. 2 are respective such sub-assemblies 40*a*, 40*b*, 40*c* and 40*d*, a separate representative assembly 40 not shown in FIG. 2, but being shown in FIGS. 4 and 5, inter alia, below (reference to any assembly 40 includes the one or more or all of the other possible sub-assemblies 40*a*, 40*b*, 40*c* and/or 40*d* or others not shown, or separately identified). Each sub-assembly 40 has a pill control sub-assembly 50 (described further below; see FIGS. 4 and 5, inter alia; reference to any assembly 50 includes the one or more or all of the other possible sub-assemblies 50*a*, and/or 50*b* of FIG. 2 or others not shown, or separately identified); though shown in FIG. 2 are respective such sub-assemblies 50*a* and 50*b*, a separate representative assembly 50 not shown in FIG. 2. Still further sub-assemblies, including a motor sub-assembly 60; a belt-driven, cup moving sub-assembly 70 and a scale sub-assembly 80 are also shown in FIG. 2; these are described further below.

Figure 3:
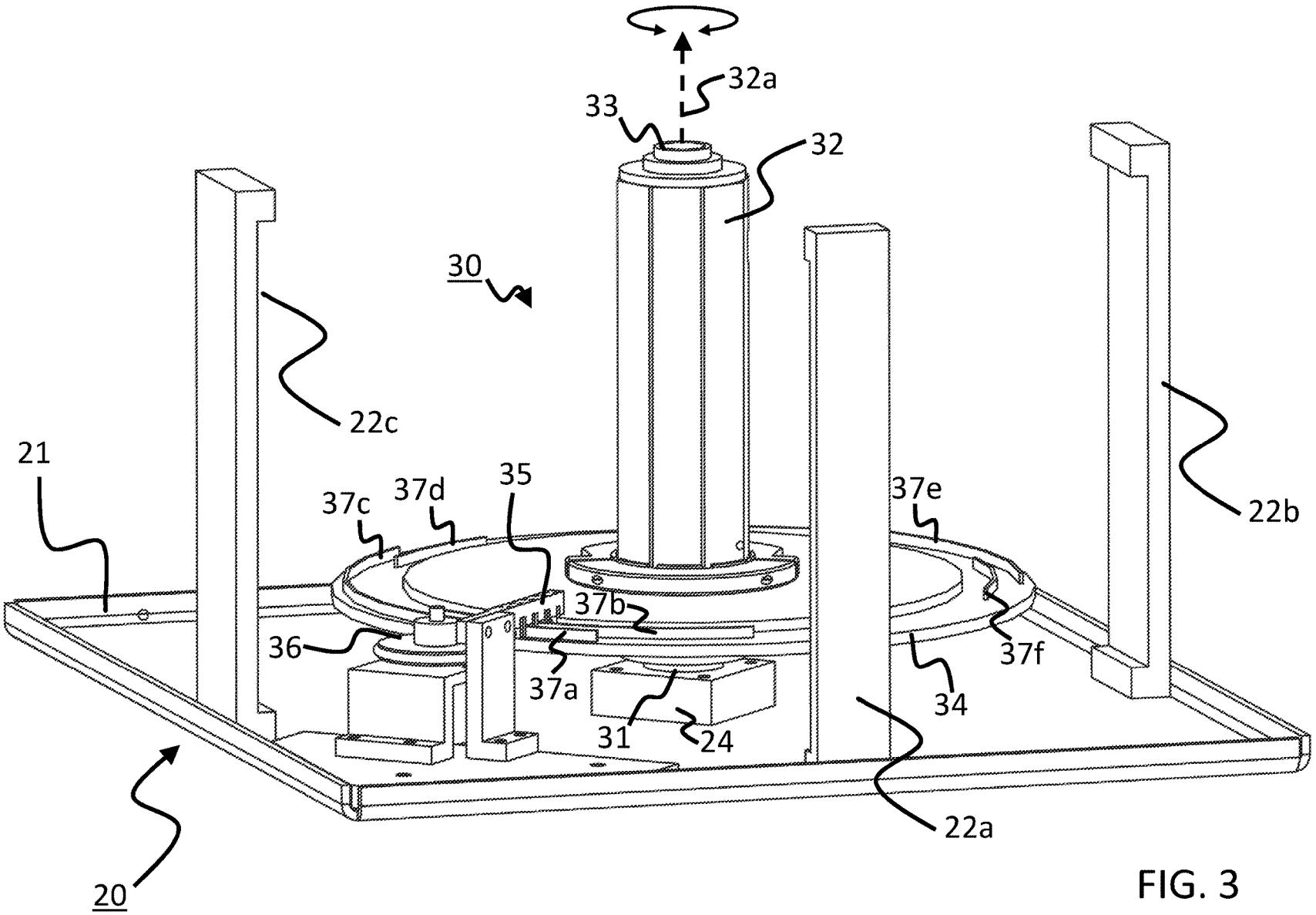
FIG. 3 provides an isometric view of some interior components of a pill dispenser according hereto.

As shown at least in FIGS. 2 and 3, the frame sub-assembly 20 may include a main base plate 21 to which may be affixed one or more support arm/s 22 (one such arm identified in FIG. 2); shown as respective arms 22*a*, 22*b* and 22*c* in FIG. 3 (reference to an arm 22 includes one or more or all of the sub-part arms 22*a*, 22*b* and/or 22*c*, unless otherwise specified). A frame top portion 23 is shown in FIG. 2 (but not in FIG. 3) with an aperture 25 defined therein; aperture 25 being disposed to receive passed therethrough one or more pills, such as pills 11 in FIG. 1, as these might initially be passed through a housing aperture 15 as described relative to FIG. 1 (see particularly FIGS. 1A and 1B). An optional cover 27 may be included to alternately open or close the aperture 25; and, this may be separately motor-driven or spring-loaded or tied/connected to the top door 15 from FIG. 1, to open and/or close therewith or in some association thereto; noting that aperture 25 may thus be disposed underneath or immediately adjacent or otherwise communicative with door/aperture 15 to provide for receiving pills to be passed therethrough to the pill assembly or assemblies 40 described below).

Two further frame sub-assembly components are also shown in FIGS. 2 and 3; relative fixed position connections 24 (lower, in FIGS. 3) and 26 (upper, in FIG. 2) may be provided in the frame 20 to provide for rotational connection of shaft 32 of rotational sub-assembly 30 within and relative to frame 20. Lower rotational connection 24 might then be relatively fixed relative to the base, here base plate 21, and upper connection 26 might then be relatively fixed relative to the top frame portion 23. Rotational bearings or other rotationally-supportive structures may be implemented at such connections 24/26; allowing for fixing the shaft 32 in an appropriate or desirable rotational disposition (further described below).

Focusing next on the rotational sub-assemblage 30 as shown in FIGS. 2 and 3 (FIG. 3 being from the reverse side of that shown in FIG. 2 and without the other sub-assemblies 40, 50, 60, 70 and 80 disposed relative thereto), this may be disposed on/in the frame sub-assembly 20 and be rotational therewithin and relative thereto. I.e., the frame 20 is relatively fixed and the rotational parts of rotational sub-assembly 30 rotate relative thereto about the axis defined axially through and by the axis of the shaft 32 (axis of shaft 32 represented schematically by dashed arrow 32*a* in FIG. 3). Shaft 32 rotates relative to the fixed connection points 24/26 by/through the rotational contact disposition of its respective ends 31 and 33 (connection of rotational upper end 33 relative to frame point/connection 26 is not separately shown, but see rotational lower end 31 relative to fixed structure 24 in FIG. 3).

An optional turntable 34 and a motor 36 are also shown, at least partially, in FIG. 2, but in more detail in FIG. 3. In the shown implementation, turntable 34 is another rotational component or part of sub-assembly 30 and is connected to shaft 32 to be rotatable/rotated therewith. Motor 36 may be, as shown in FIGS. 2 and 3, fixed to the frame 20, as on or adjacent base plate 21, but as shown here would engage the rotational components, one or both of the shaft 32 and/or turntable 34 to rotate same. Here shown is engagement of motor 36 with turntable 34, by which the motor rotates the turntable which in turn carries with it and rotates the shaft 32 about axis 32*a*. The rotational connection/communication may be one or more of many sorts and may include, inter alia, a belt drive (not shown), gears (not shown) or a frictional engagement of the motor 36 with a surface or edge of the table 34 or shaft 32.

The turntable, if used, may be used for, inter alia, spinning the shaft (see above); and/or for carrying a load (see alternative description relative to sub-assemblies 40 below); and/or may be used for positional control and/or sensing. For this latter, shown also in FIG. 3 is inclusion of an optional sensor array 35 that may also be disposed to operationally interface with one or more parts of an encoder wheel; see ridges or projections 37, which are referred to as "contacts" in wheel encoding terminology even in non-contact examples; hence, projections 37 are referred to as contacts 37 hereafter. Contacts 37 are defined by and include the disparate contacts 37*a*, 37*b*, 37*c*, 37*d*, 37*e* and 37*f* shown in FIG. 3, inter alia (reference to one or more contacts 37 includes one or more or all of the sub-part contacts 37*a*, 37*b*, 37*c*, 37*d*, 37*e* and 37*f*, inter alia; potentially one or more not shown) to provide angular position information to control electronics or control system (described below). Array 35 can be optical, electrical (e.g., capacitive), magnetic, contact or other form of sensor array to sense corresponding indicia, here contacts, on the turntable or shaft or other part of the rotating sub-assembly. Though a variety of encoding options might be used (e.g., binary, et al.); in some alternatives, Gray encoding may be used.

In operation in short, when the turntable 34 is rotated, different combinations of contacts 37, or no contacts, will be disposed adjacent the sensor array 35 and the sensor array 35 may be disposed to sense the relative presence or absence of those none, one or more contacts 37 (again, including one or more sub-part contacts 37*a*, 37*b*, 37*c*, 37*d*, 37*e* and 37*f*, inter alia), and by that information determine the relative position of the table 34 and/or shaft 32, and by consequence any pill handlers 40. By this, the control electronics or control system will 'know' which of potentially one or more pill handling assemblies 40 is disposed at a particular location. In FIG. 3, it appears that only contacts 37*a* and 37*b* are in relative of range of sensing by the array 35, the other contacts 37*c*, 37*d*, 37*e* and 37*f*, inter alia, not being present there and thus not being sensed in this particular disposition. And, referring briefly back to the view of FIG. 2, inasmuch as any of the pill sub-assemblies can be rotated to the desired position; here, however, shown is pill sub-assembly 40*d* in pill receiving disposition below the 25 for pills to be initially delivered thereto (see FIG. 1A) and pill sub-assembly 40*b* in the desired pill delivery position relative to motor assembly 60 and the scale receiver 82 of scale sub-assembly 80 (see FIGS. 4 and 5 described below); more details of the operation and relative dispositions of which to be provided below, the note being that a particular arrangement of contacts can be used to establish what assembly 40 is disposed after rotation to be at the particular designated position for further operation/pill receiving and/or delivery. If and when a different pill or group of pills from/to a different sub-assembly 40 is desired to be delivered or received, then, the motor 36 may actuated and thereby be used to rotate the overall movable sub-assembly 30 to move the newly desired pill handling assembly 40 to the required position for delivery or receipt. Note, a number of robust alternative rotary position sensors may be available and/or substituted herefor.

Further shown in FIG. 2, and to be described in further detail below are several parts of the pill delivery sub-assembly 50, motors 62 and 64 of motor sub-assembly 60, and for the cup moving sub-assembly 70, a rail 72, drive belt 74, motor 76, movable base 77 and cup 78 (which might be the same as cup 18 from FIG. 1, though is shown in a slightly different non-pivotal implementation in FIG. 2, thus, re-numbered 78, here). Also shown is scale sub-assembly 80 with receiving/tilting cup 82, to be described further below.

Also included as introduced relative to FIG. 2 may be one or multiple pill storage and handling sub-assemblies 40 (shown as sub-assemblies 40*a*, 40*b*, 40*c* and 40*d* in FIG. 2). These sub-assemblies may, as shown in FIG. 4 (as defined by and including sub-part FIGS. 4A, 4B, 4C, 4D and 4E), et al., include one or more corresponding pill storage bins 44, one or more corresponding ridged conveyor belts 46, respective chutes or slides 48 and gate/delivery sub-assemblies 50 (all described further below), all of which being operationally fixed to or relative to a frame 42 and/or a base 41. These one or more pill storage and handling assemblies 40 are in this implementation attached to the central shaft 32 above the turntable, shown in FIGS. 2 and 3 and are thereby rotatable therewith. As introduced in FIG. 2, several such assemblies 40 are visible (see 40*a*, 40*b*, 40*c* and 40*d*, inter alia), though several more are not visible being disposed behind the visible examples and/or under the frame part 23. As shown, these may particularly be arranged when multiple such assemblies are used in or extending in a radial orientation about and extending out from the central shaft 32.

In some alternatives of connection of one or more assemblies 40 to the rotatable sub-assembly 30, a first note may be made of the several substantially flat surfaces presented by the shaft 32 of FIG. 3; such surfaces being so configured to readily accept connection by a rear surface 42*a* (see FIG. 4A, described below) of a sub-assembly 40, as by riveting, bolting, welding or some other fixation process, removable or not (numerous options beyond these may also be used). It may be alternatively that the base 41 is configured for attachment to the shaft 32, or may alternatively be configured for attachment to a turntable not unlike turntable 34 (though not likely with the encoder wheel implementation on the top side of the table as shown in FIG. 3; though could be if/when perhaps with an encoder wheel disposition on the bottom, or on a separate portion altogether or even optionally on a separate table separately attached to the shaft but, moving together therewith). Fixed or removable options for one or more assemblies 40 relative to rotatable assembly 30 a numerous and varied.

Figure 4A:
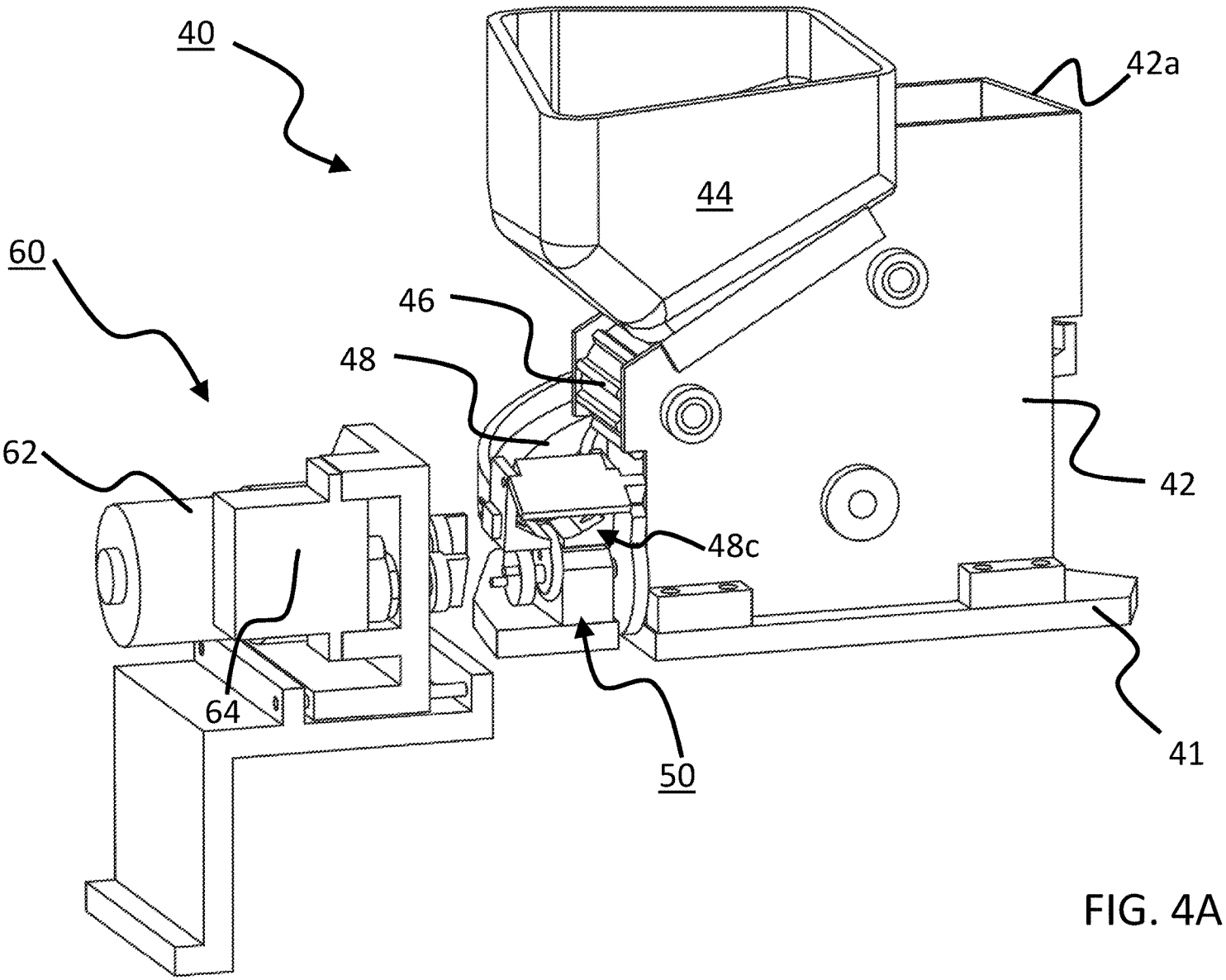
FIG. 4, which is defined by and includes sub-part FIGS. 4A, 4B, 4C, 4D and 4E, provides isometric views of some interior components, some partially cut-away, of a pill dispenser according hereto.
Figure 4B:
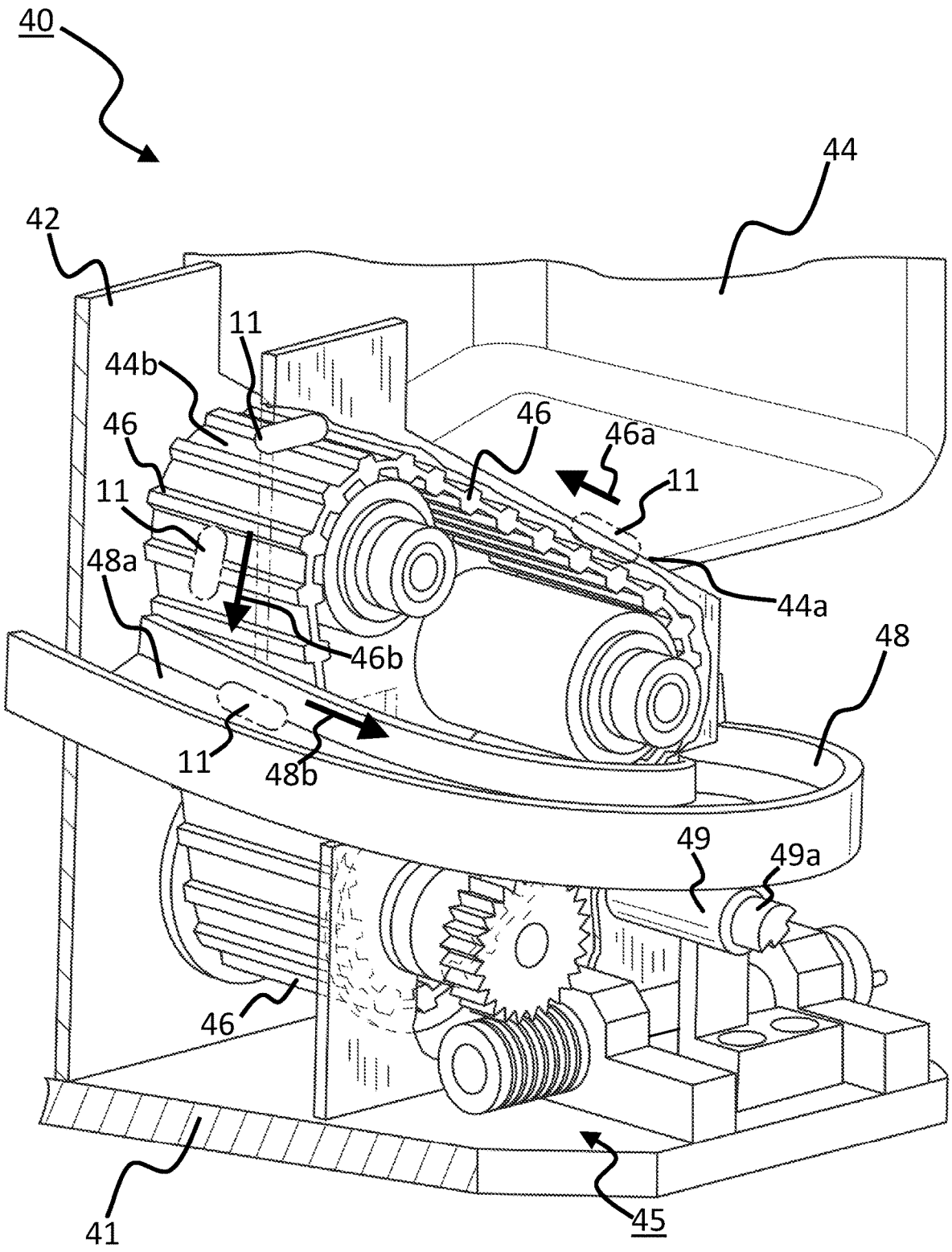

More details of pill storage and/or handling sub-assemblies 40 will now be described, with at least initial particular detail relative to FIG. 4 (defined by and including sub-part FIGS. 4A-4E), inter alia. The pill storage bins 44, as introduced above, are open on the top to allow for pill loading (as from and through the aperture 25 in frame 20 (FIG. 2) as fed by and through the aperture 15 in the housing 12 (FIG. 1)). A section of and/or communicative with the interior of each storage bin 44 may include a motor driven conveyor belt 46 which receives and delivers a desired and/or programmed and/or small number of pills 11 to be placed into the corresponding pill trough or chute 48. This can be seen in further detail in FIG. 4B, for example, where one or more pills 11 may be picked up by the conveyor 46 in or from the bin 44, at or in the area or location 44*a*, carried by the conveyor belt 46 toward (see arrow 46*a*) and delivered at bin exit area or location 44*b* to a chute 48, often herein also referred to as a slide 48. In FIG. 4B, the conveyor lifts the pill or pills 11 out of the bin 44 (arrow 46*a*) and then delivers them to a location where the pill or pills 11 fall (see arrow 46*b*) from the conveyor belt 46 to the chute 48. Though a lifting conveyor is shown here, a relative lateral or even decline conveyor (neither shown) could instead be used in an appropriate arrangement.

A conveyor moving sub-assembly 45 may be as shown (unshown alternatives may be used instead). Such a conveyor moving sub-assembly 45 is shown in FIG. 4B, but in more detail in FIG. 4C (inasmuch as a portion of the chute/slide 48 is shown cut-away in FIG. 4C). A worm gear 45*a* is shown as it might be engaging a rotational gear 45*b* that spins a shaft or axle 45*c*. Axle 45*c* is operationally supported by side walls 42*b* and 42*c* and turns an internal toothed drum 45*d* (indicated partially by dashed lines as partially hidden by side wall 42*c* and indicated here with a dashed leader line) which in turn engages the interior ridges of the conveyor belt 46. Rotation of the worm gear 45*a* in the direction indicated by the arrow 45*e* causes the rotational gear 45*b* to rotate in the direction indicated by arrow 46*f*; this then causes the belt 46 to move as indicated by the arrow 46*c*. To get the worm gear 45*a* to turn, the shaft 43 is engaged by a motor 62 (shown in FIGS. 4A and 4D, but, not shown in any of the other sub-parts 4B, 4C or 4E). An engagement part 47 connected to the shaft 43 provides for the operational connection with motor 62 as described below.

First, returning to FIG. 4B, gravity may be used as shown to assist in delivery from the conveyor 46 to the chute 48, the pill or pills 11 falling 46*b* from the conveyor 46 at the top or delivery end/location 44*b* thereof. The pill or pills 11 may then move along chute 48 as shown by arrow 48*a*. Here also, gravity may be used to assist in having the pill or pills 11 slide down the chute or slide 48, or the chute may be rather disposed for lateral movement or even upward movement depending upon circumstances and movement assist options that might be used. The pill or pills 11 would then be delivered to the pill delivery sub-assembly 50 described further below.

Figure 4C:
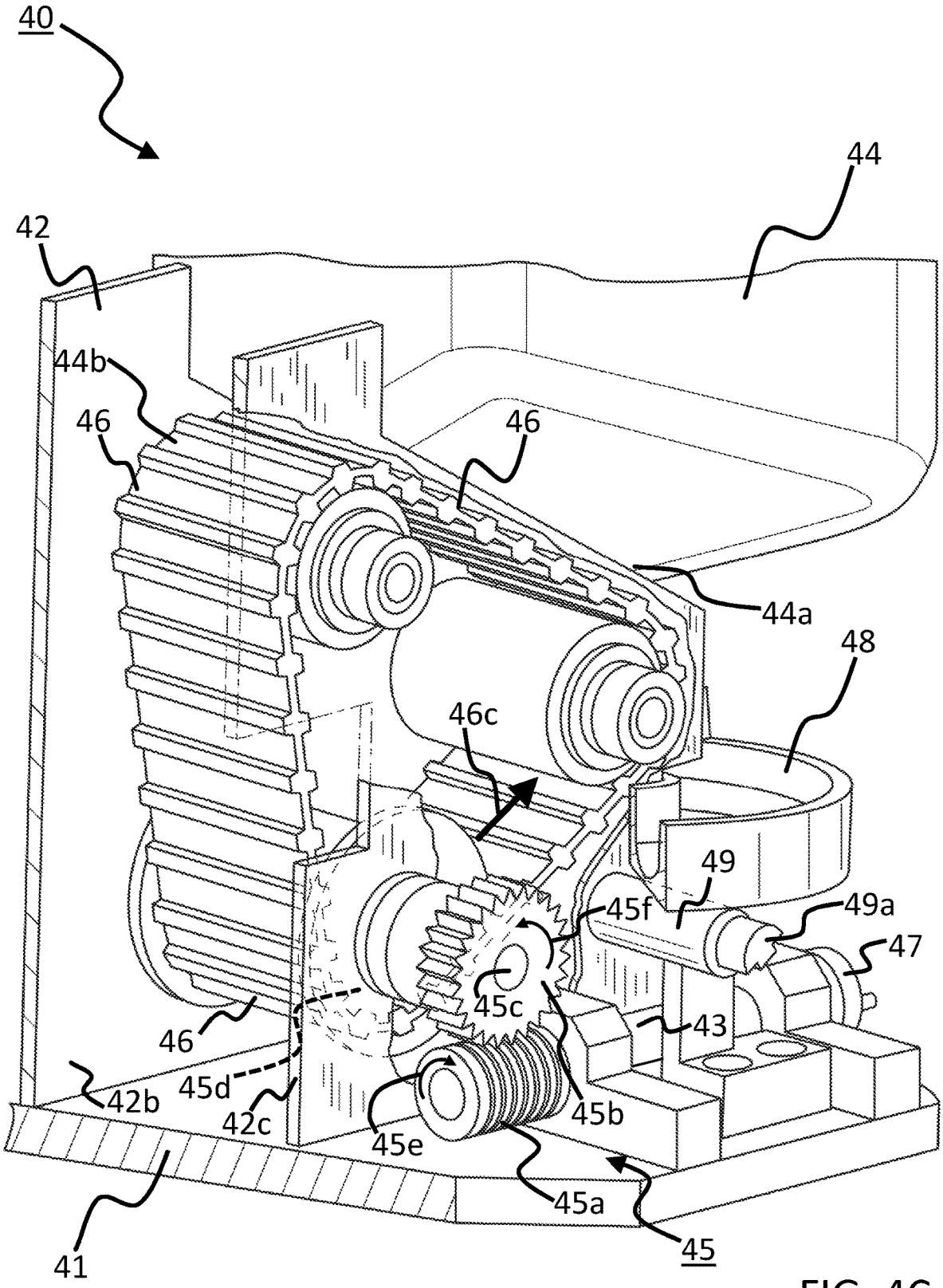

Also shown in FIGS. 4B and 4C is a vibratory motor 49 that may also be used to move a pill or pills 11 along the chute 46. In an example such as that shown in FIGS. 4B and 4C, the motor 49 may be a rotational motor attached or operationally connected to the chute 46 so that in rotating an end 49*a* projecting therefrom, particularly an eccentrically formed end 49*a* as shown may cause a rotational fluctuation that results in a vibration on chute 46. The vibration can then cause the pill or pills 11 to move in and along the chute 46. Other vibratory devices or other movement assist methods or devices might be used in addition or instead. Gravity may also be sufficient in some implementations. Note, in some implementations, the pill storage and movement assemblies 40 may be attached to the central shaft with a relatively flexible mount 42*a* as shown in FIG. 4A. A flexible mount may assist an electric vibrator 49 to agitate the respective pill storage and movement assembly 40 to cause the pills, having been placed near the top of the pill trough 48*a* after the conveyor belt motion, to travel (see arrow 48*b*) to the pill drop off location near the lower end 48*c* of the pill trough 48 (pill drop off location not shown in FIGS. 4B and 4C, but see FIGS. 4A, 4D and 4E, described further below). As described further below, the pills in a pill trough 48 align in the trough to form a single line, generally end to end, the leading pill being at the end of the trough or chute 48 at the pill drop off location (again, see FIGS. 4A, 4D and 4E). This final stationary position of the pill 11 at the lower end 48*c* of the trough 48 is sometimes also referred to herein as "The Known Location."

Figure 4D:
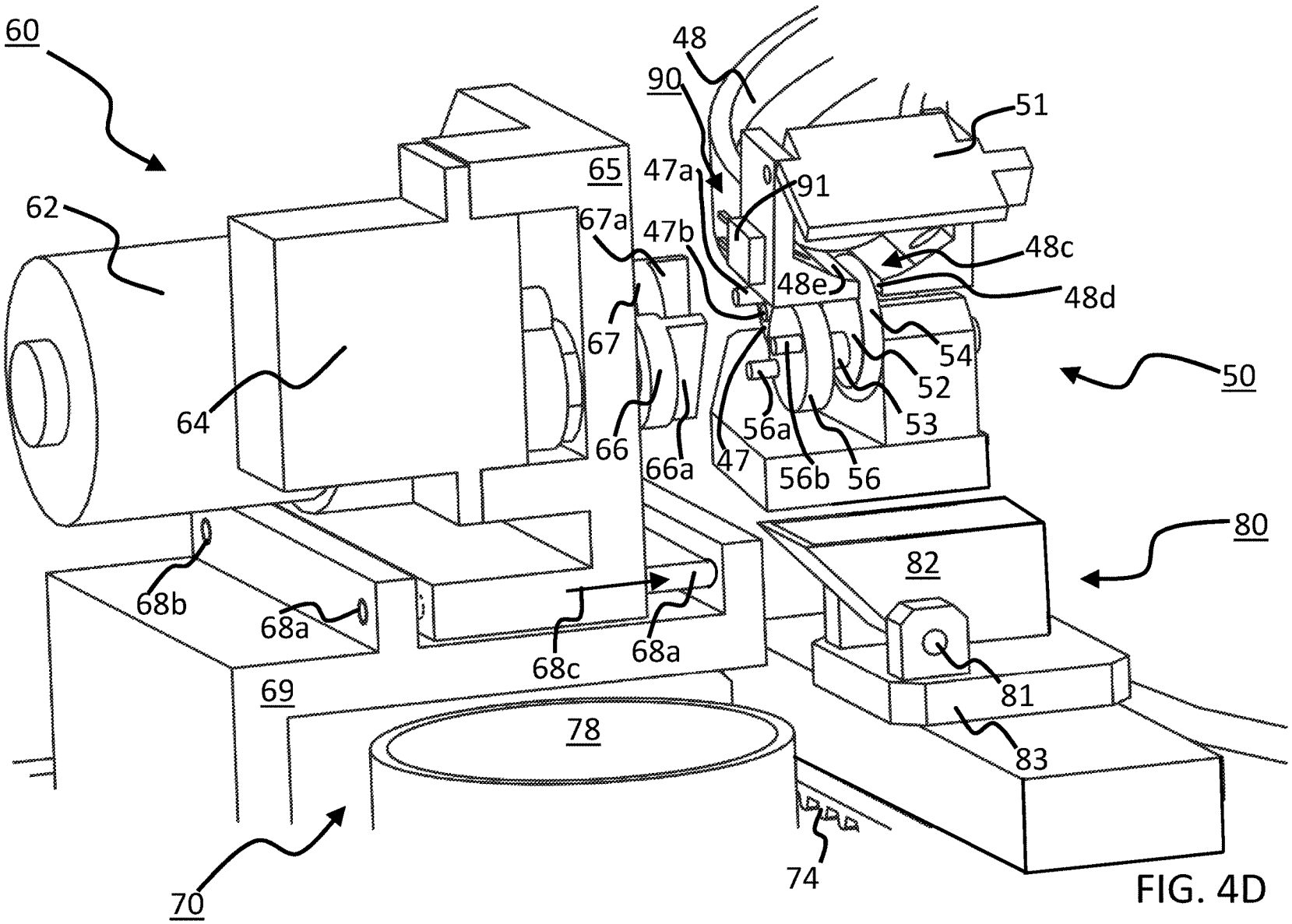
Figure 4E:
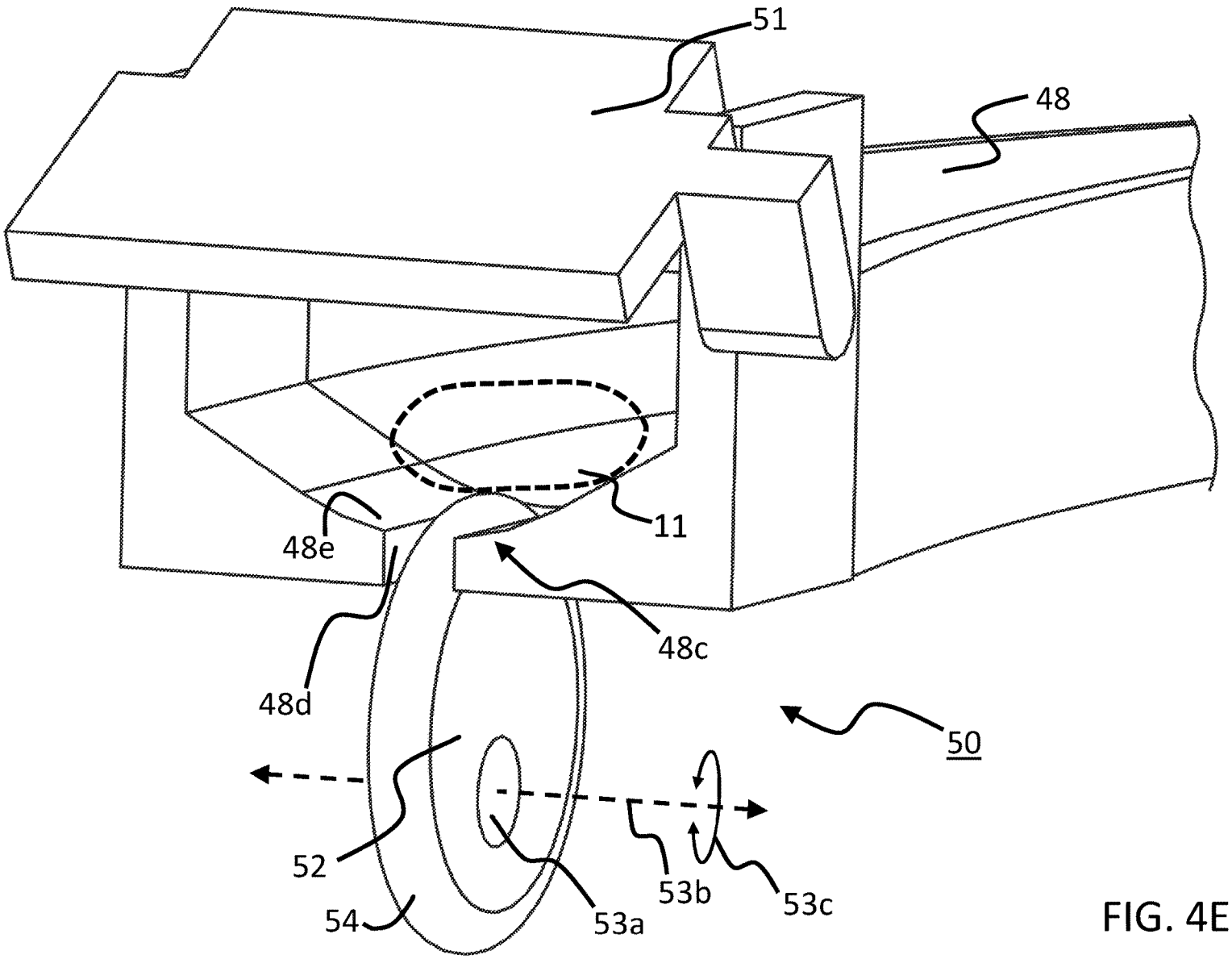

The Known Location 48*c* is thus disposed at and/or adjacent the pill gate or delivery sub-assembly 50 and more particularly at or adjacent the door 51 of sub-assembly 50. Though introduced above, sub-assembly 50 is shown in greater detail in FIGS. 4D and 4E; the pill delivery sub-assembly 50 being shown enlarged and isolated from most of the other elements/sub-assemblies in FIG. 4E, but isometrically is shown operationally adjacent and together with other operational features 48, 60, 70 and 80 (or at least one or more parts thereof) in FIG. 4D. The sub-assembly 50 may, as shown in FIGS. 4D and 4E, contain a gate or shutter 51 and a pick-up member 52, in the shown implementations also referred to as a delivery cam 52 (reference to either is intended to include the other herein). The shown implementation is of a rotational pick-up member 52, though non-rotational implementations may be used. Moreover, the shown implementation of cam 52 is as an off-center cam, the cam being rotatable on a relatively fixed axis, though off-center thereof so that alternately a smaller part and then a larger part of the cam is rotated to and/or relative to the known location 48*c*. The pick-up member or delivery cam 52 is shown being substantially and/or operationally near and disposed mostly below the lower end 48*c* of the pill trough or chute 48. The cam 52 is disposed relative to the chute 48 such that it is operatively movable within a slot 48*d* defined by opposing sidewalls within chute 48. The rotation of the cam 52 within the slot 48*d* is such that the cam 52 is at times disposed below the interior surface 48*e* of chute 48, and at other times at and at other times above the surface 48*e* of chute 48; surface 48*e* being only partially visible in FIG. 4D, but more visible in 4E.

Also shown in FIG. 4D is an axle or shaft 53 and an engaging surface 54, both being operationally connected to pick-up and/or delivery member or cam 52. In FIG. 4E, the engaging surface 54 is shown, but, the cam 52 includes only the aperture 53*a* in/through which the axle 53 is/would be disposed. An axis of rotation 53*b* is also shown in FIG. 4E with an indication at arrow 53*c* of rotation that may be used for the cam 52. The cam 52 may thus be operationally disposed upon an axle or shaft 53 which can then impart rotation to the cam 52 to such that the cam 52 may engage a single pill 11 (dashed line representation in FIG. 4E, not shown in FIG. 4D), regardless of practical size (practical sizing including and/or meaning within an appropriate human or other animal condition; not too big to be delivered to the human or animal, and not too small to not be readily manipulatable for ordinary use), may be moved off the end of the trough or chute 48 and fall by gravity to the scale and/or dispensing sub-assemblies 80/70 as described further below, particularly with regard to FIG. 5 (defined by and including sub-part FIGS. 5A, 5B, 5C, 5D, 5E, 5F and 5G). Note, shown is an eccentric or off-center cam 52, which here may be rotated about a relatively fixed axis 53*c* such that initially, the smaller part of the cam 52 is adjacent the known location 48*c*, and then in further rotation, the larger part of the cam 52 rotates up into the slot 48*d* to the known location 48*c* eventually rising above surface 48*e* (if only minisculely, though to whatever extent necessary to engage and move a pill 11) and thereby engaging pill 11. Continued rotation moves the pill off surface 48*e*, whether by lifting pill 11 off surface 48*e* or simply moving pill 11 along the surface 48*e* to ultimately drop off as described below. Other shapes or types of cams or moving members 52 may be employed in alternative to the desired effect.

Further, in FIG. 4D, some other operational sub-parts of an implementation of the developments hereof can be seen slightly enlarged from the exemplar disposition shown in FIG. 2. For example, a scale receiving cup 82 may be used, cup 82 being part of sub-assembly 80, and being disposed sufficiently under and near the delivery end of sub-assemblies 40 and 50 such that a pill (not shown in FIG. 4D) may fall thereinto as/when desired. Similarly, a delivery cup 78 of delivery sub-assembly 70 may be, as shown, disposed to operationally receive a pill from the scale cup 82 when appropriate. Scale cup 82 is shown pivotally disposed about more pivot pins, one pin 81 shown, relative to a scale base 83. A portion of the conveyor belt 74 is also visible, though more detail description and visibility of this and other parts of sub-assembly 70 are set forth below (see FIG. 5 description, e.g.).

To rotate the cam 52, a motor 64 of motor sub-assembly 60 may be used. A motor 62 also of sub-assembly 60 may be used to engage and move the conveyor 46 via assembly 45 as is also described herein. Motor sub-assembly 60 may include as shown here a fixed frame part 69 and a movable frame part 65 on or to which the motors 62 and/or 64 may be disposed. The motors 62, 64 then each may have a rotational end feature 67, 66 each of which being preferably configured to engage respective engagement parts 47 and 56. The engagement of the implementations shown is by a respective projecting blade 67*a*, 66*a* that each respectively engage the respective engagement parts 47, 56 in between respective projecting pins 47*a*, 47*b* of engagement part 47 and pins 56*a*, 56*b* of part 56. I.e., blade 67*a* is extended to and becomes operationally disposed between respective pins 47*a*, 47*b*; and, discretely, blade 66*a* of motor 64 is extended to and becomes operationally disposed between pins 56*a* and 56*b*. Then, respectively, rotation by motor 64, for a first example, of its end part 66 and consequently also blade 66*a*, then causes blade 66*a* to engage and move the pins 56*a*, 56*b* which in turn, causes rotational turning of engagement end 56 which turns axle/shaft 53 to in turn, also cause rotation of cam 52—this would achieve the rotational effect indicated as/by arrow 53*c* (FIG. 4E) and get the cam to and through the desired positions for pill delivery. Similarly, rotation by motor 62, for a second example, of its end part 67 and consequently also blade 67*a*, then causes blade 67*a* to engage and move the pins 47*a*, 47*b* which in turn, causes rotational turning of engagement end 47 (better shown in FIG. 4C) which turns shaft/rod 43 to in turn, also cause rotation of the gear system 45 (e.g., worm gear 45*a* and rotational gear 45*b* to in turn move conveyor 46, as described with respect to FIG. 4C, above).

The extension of the end features 66, 67 can be accomplished in a variety of ways, though here shown is a movability of the frame part 65 on/relative to a pair of rails 68*a*, 68*b* (rail 68*b* mostly hidden though visible at its rear end part as it may extend through the fixed part of the frame 69). The movement of frame 65 may thus be in a direction as indicated by arrow 68*c* (along rail 68*a*) in a relative forward fashion for and toward and to engagement with the engagement ends 47, 56. When disengagement is desired a reverse movement of the frame 65 relative to rails 68 (defined by and including sub-parts 68*a* and/or 68*b*) and frame 69 to the position shown in FIG. 4D.

Such a dis-engageable engagement of a motor sub-assembly 60 as this may provide an optional ability to have one set of motors configured to engage (and dis-engage) with more than one (i.e., a plurality) of pill handling (conveyor) and gate delivery (cam) sub-assemblies 40, 50. E.g., in FIG. 2, between four and eight possible such assemblies 40, 50 are shown (four clearly visible (identified as 40*a*, 40*b*, 40*c* and 40*d*), two—three further ones barely visible (few parts thereof), and one to two possible additional ones completely hidden behind and under the cover 23); any and each of which set of sub-assemblies 40, 50 being discretely and dis-engagably engagable with the set of motors 62, 64 in the single motor sub-assembly 60. Thus, one set of pills may be the subject of a particular delivery from any one particular set of conveyor/cam sub-assemblies 40, 50 at any particular time, and then, a subsequent operation with a different set of sub-assemblies, which may have a different kind/type of pill disposed therein, can then be moved (rotated on shaft 34) to the motor engaging position (see e.g., the sub-assembly 40*b* in FIG. 2 with its associated gate/cam sub-assembly both disposed in motor-engaging position opposite the motor sub-assembly 60) to undergo a respective pill delivery operation.

Figure 5A:
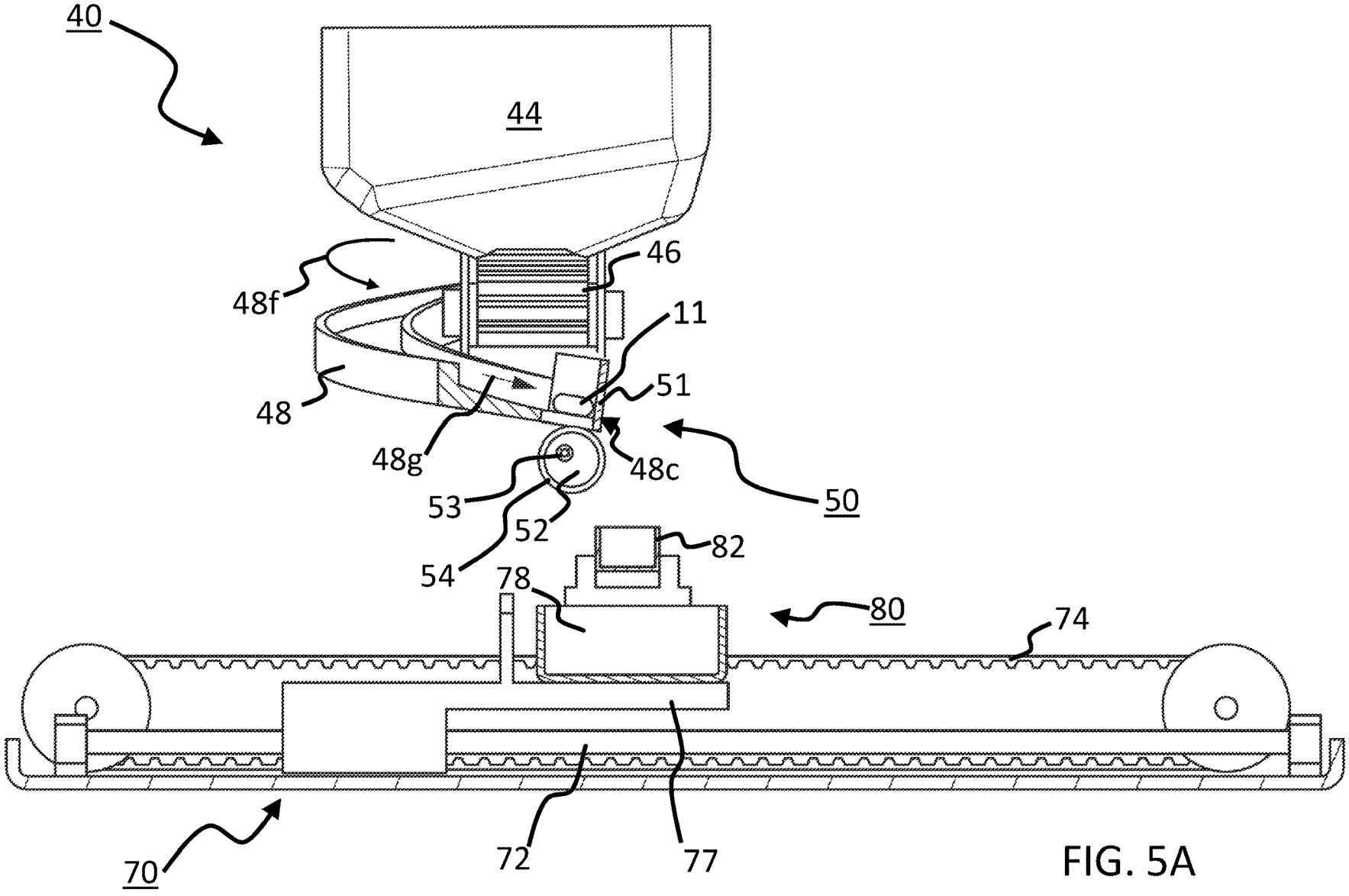
FIG. 5, which is defined by and includes sub-part FIGS. 5A, 5B, 5C, 5D, 5E, 5F and 5G, provides elevational views, some partially cut-away, of some interior components of a pill dispenser according hereto.

A pill delivery option will now be described relative to FIG. 5 (defined by and including sub-part FIGS. 5A, 5B, 5C, 5D, 5E, 5F and 5G). First, shown in FIG. 5A is a pill handling sub-assembly 40, a corresponding pill control sub-assembly 50, a scale sub-assembly 80 and an exit cup sub-assembly 70. The dominant parts thereof include bin 44, conveyor 46 and chute 48 of pill handling assembly 40; gate/door 51, cam 52, shaft 53 and pill handling/engaging surface 54 of sub-assembly 50; rail 72, belt 74, movable base 77 and cup 78 of assembly 70 and scale cup 82 of scale sub-assembly 80. Continuing the progression of a pill through a system or sub-combination hereof as from FIG. 4C; where a pill 11 was taken from a conveyor loading area 44*a* in a direction 46*a* on the conveyor 46 to a pill dropping location 44*b*, dropped in a direction 46*b* to the pill receiving location 48*a* of slide/chute 48; the pill then sliding along the slide/chute 48, first in direction 48*b* ultimately to the pill known location 48*c* (not shown FIG. 4C, but see FIGS. 4D and 4E, inter alia). Shown as a furtherance thereof in FIG. 5A is a first directional arrow 48*f* indicating a movement of the pill along the curvature of the chute/slide 48 to the final movement arrow 48*g* in/associated with the chute/slide 48. Arrow 48*g* shows the pill 11 on final approach to the pill known location 48*c*.

Figure 5B:
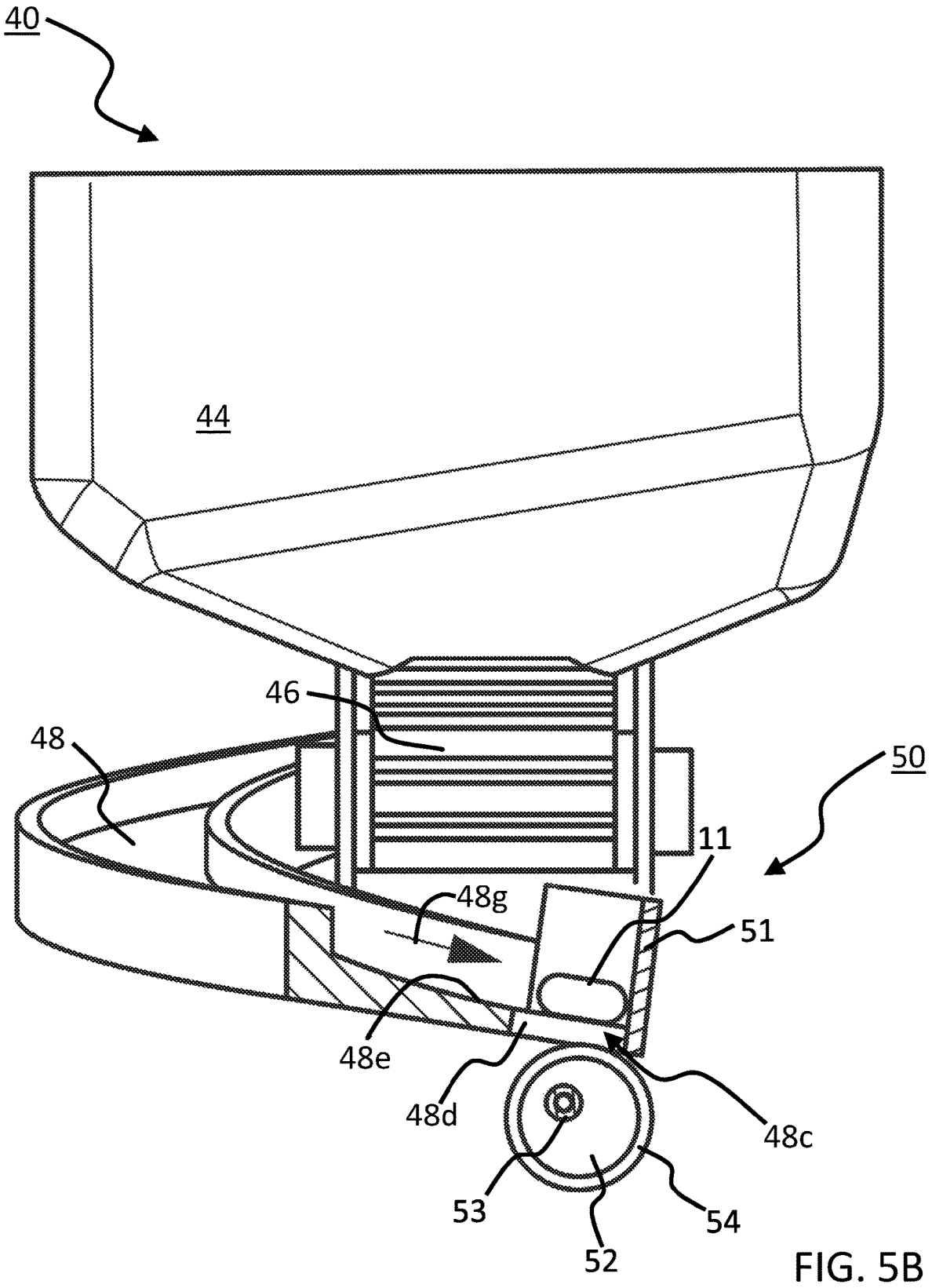

At this point, the pill control sub-assembly 50 takes over control of the further handling and delivery of a single pill 11. Note, first, FIG. 5B shows an identical position of the pill 11 relative to the pill handling and control assemblies 40, 50, though enlarged for further detail in the description of the process, thus, here forward the process will be described relative to FIG. 5B, first, then, also to and through further FIGS. 5C, 5D, 5E, 5F and 5G. As shown in FIG. 5B, the door 51 is closed at the close of the chute movement and the initiation of a control and delivery process using sub-assembly 50. Also at this initial point of the assembly 50 process, the cam 52, here an eccentric or off-center cam 52, is disposed in an initial position of relative rotation (about shaft 53) relative to the slot 48*d* where the cam 52 is below the surface 48*e* of the chute 48 and thus as introduced above, a smaller part of cam 52 being directly under the known location 48*c*, the cam is not yet engaged with the pill 11.

Figure 5C:
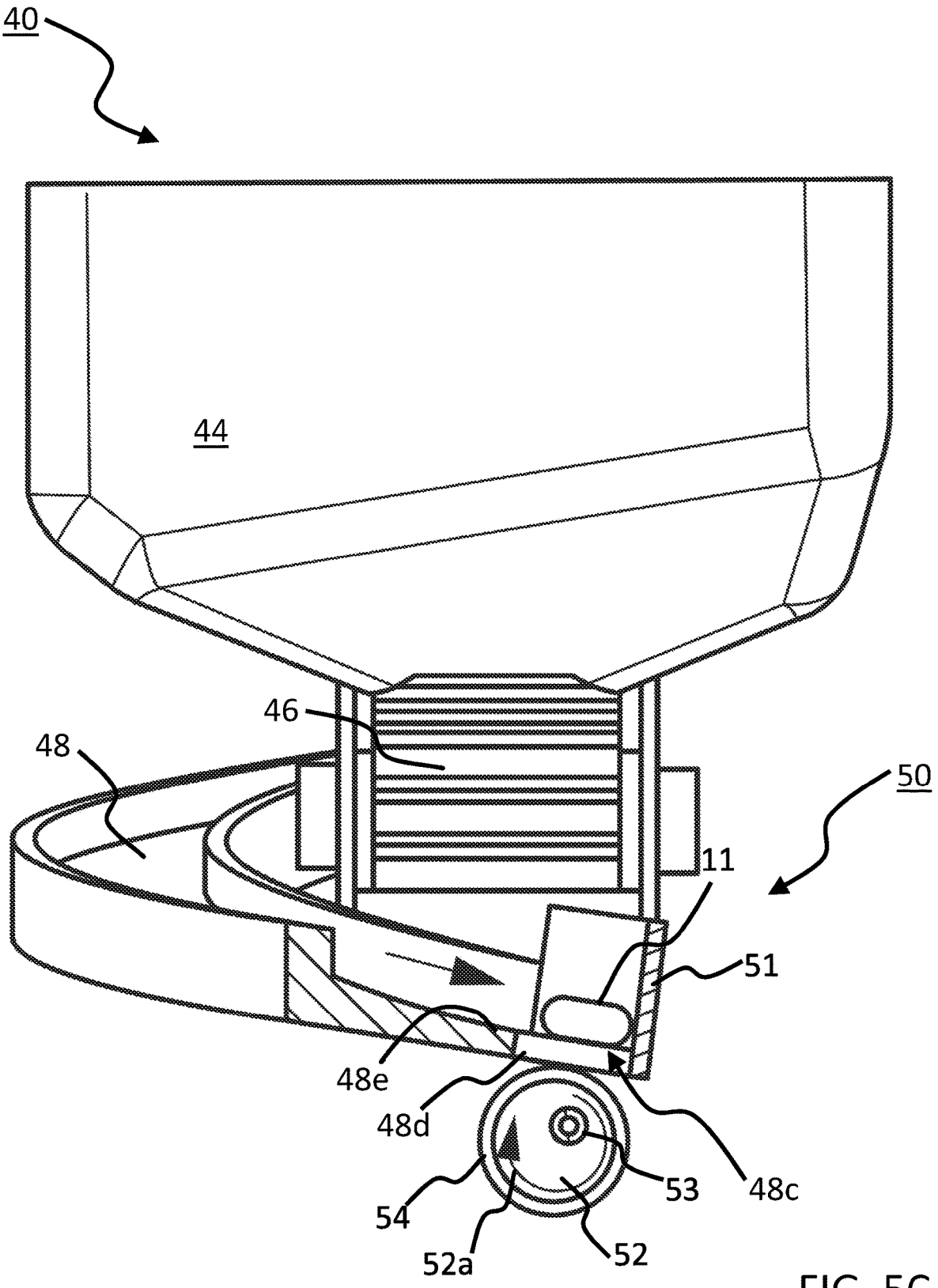

Moving next to FIG. 5C, the cam 52 is shown in partial rotation, rotating in the direction set forth by arrow 52*a*; the smaller part of cam 52 still substantially below the surface 48*e* and pill 11; however, as then shown in FIG. 5D, with still further continued rotation in the direction 52*a*, the larger part of the eccentric or off-center cam 52 is then rotated up into the slot 48*d*, eventually raising at least a little above the surface 48*e* and thereby lifting the pill 11 up, though it might simply engage and move the pill without perhaps actually lifting it per se. The pill-engaging surface 54 may be configured to be sufficiently frictional to in effect grab the pill 11 and move the pill 11 with the cam 52 and move it therewith in the direction of the arrow 52*a*; see below (as such a rubberized surface as might be presented by an o-ring might be employed for surface 54).

Figure 5D:
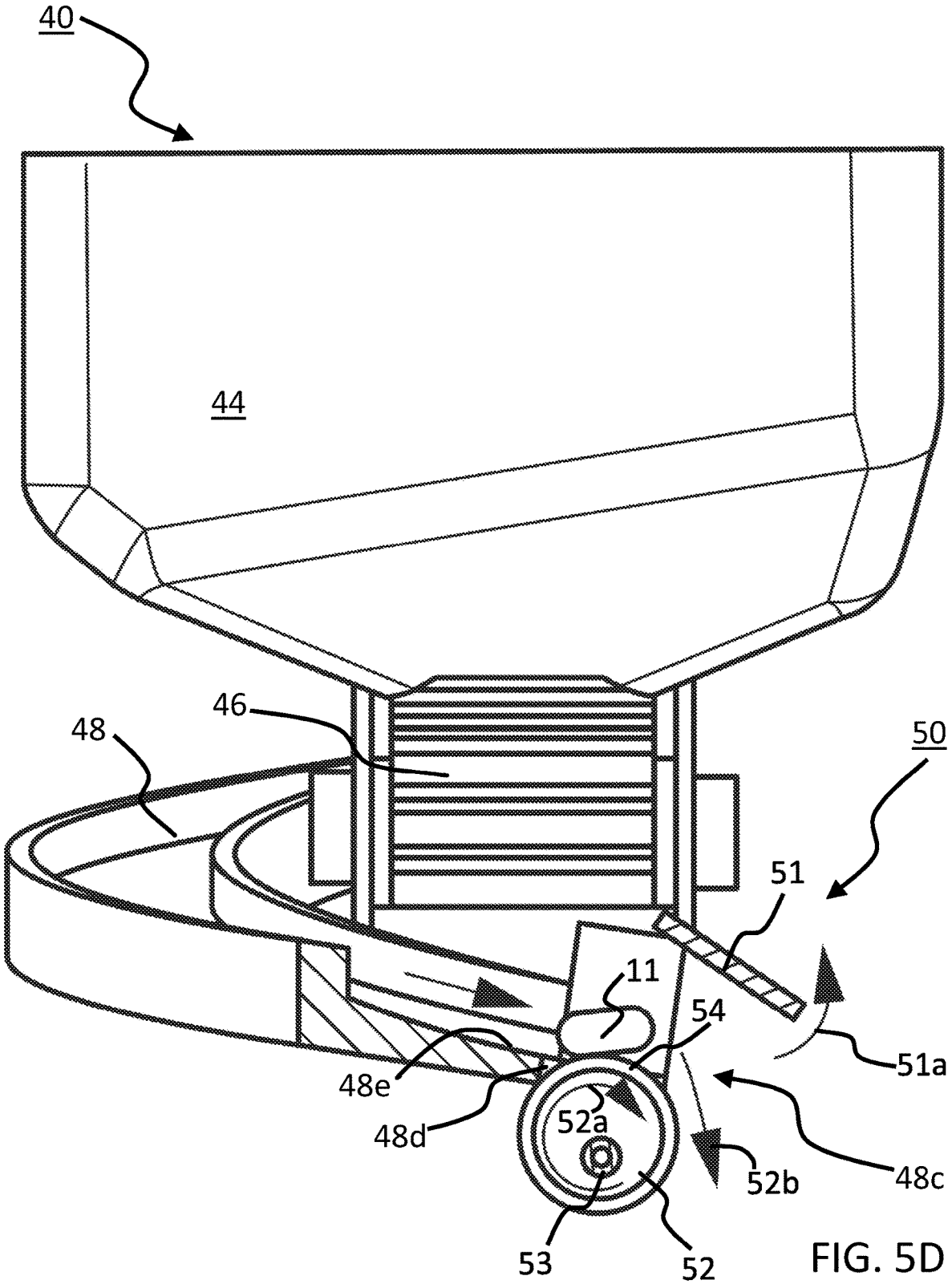

Remaining with FIG. 5D briefly, we see also that the door 51 is opened or at least in the process of opening, see arrow 51*a* indicating the rotational, hinge-like movement of the gate or door 51. It is noted briefly here that the door 51 may be opened with the lifting and moving of the pill 11 by cam 52. Indeed, the same mechanism for rotating cam 52 may be used for opening door 51, so operation thereof may be connected, or alternatively, the door 51 may be opened in a discrete operation and using a discrete motor (not separately shown). Operation of the door 51 may nevertheless occur simultaneous with or near in time to the lifting and moving of the pill 11, or in some implementations, operation, i.e., opening of the door 51 may be completely independent of the movement of the pill. Even so, the door 51 will be coordinated so that when the pill 11 is sufficiently ready for being moved off the cam 52, the door will be open or opened. In some implementations, separately controllable door opening and perhaps more interestingly (in perhaps some cases), door closing may be tightly controlled for different sized pills; e.g., smaller pills 11 may invoke a desire for quicker door closing operations to ensure catching any following pills in/on the chute 48 after the one being delivered; e.g., closing before the pill is completely dropped off to stop the next pill in line from moving out of turn. Larger pills may allow for longer or slower closing times.

Figure 5E:
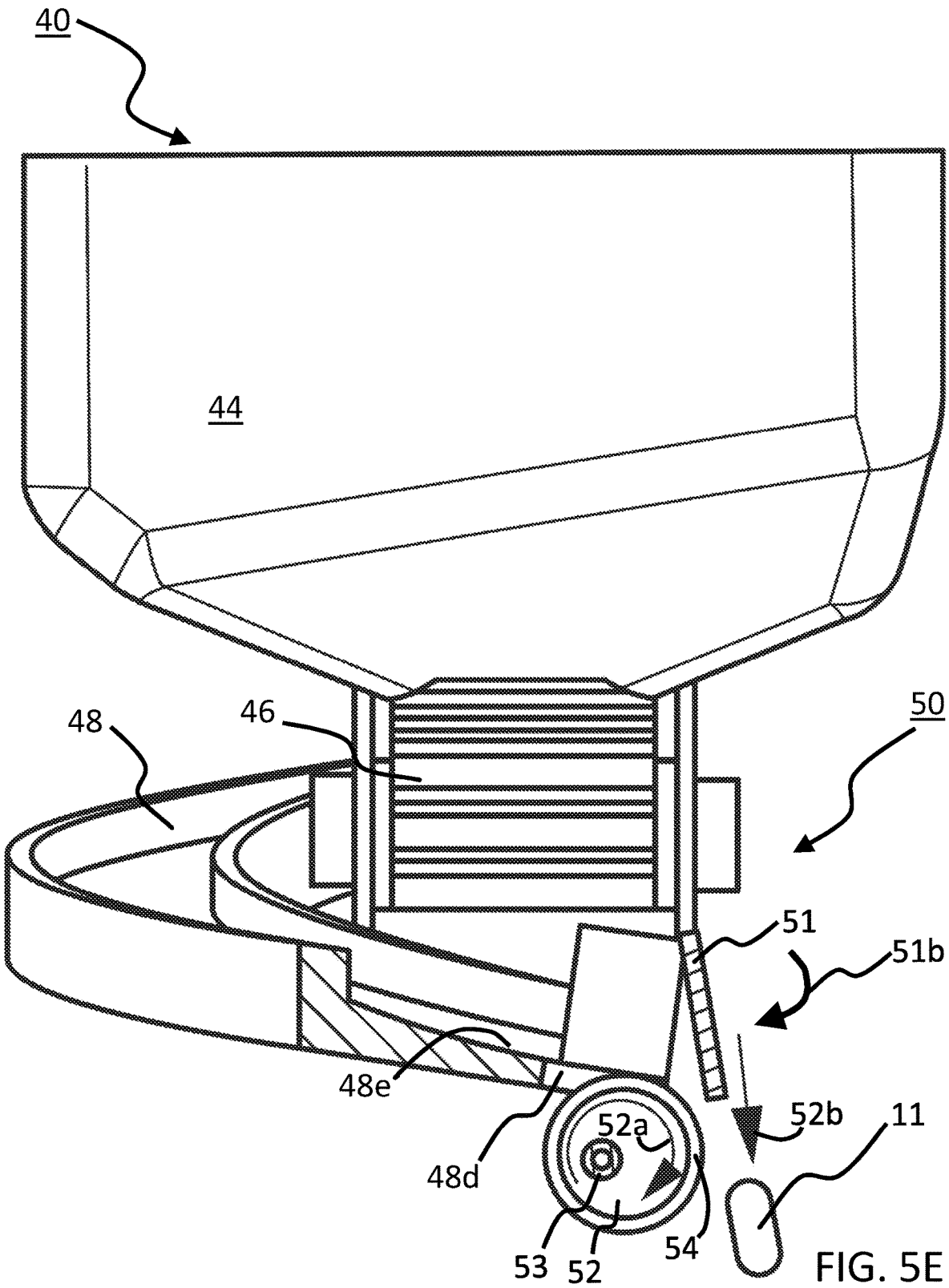
Figure 5F:
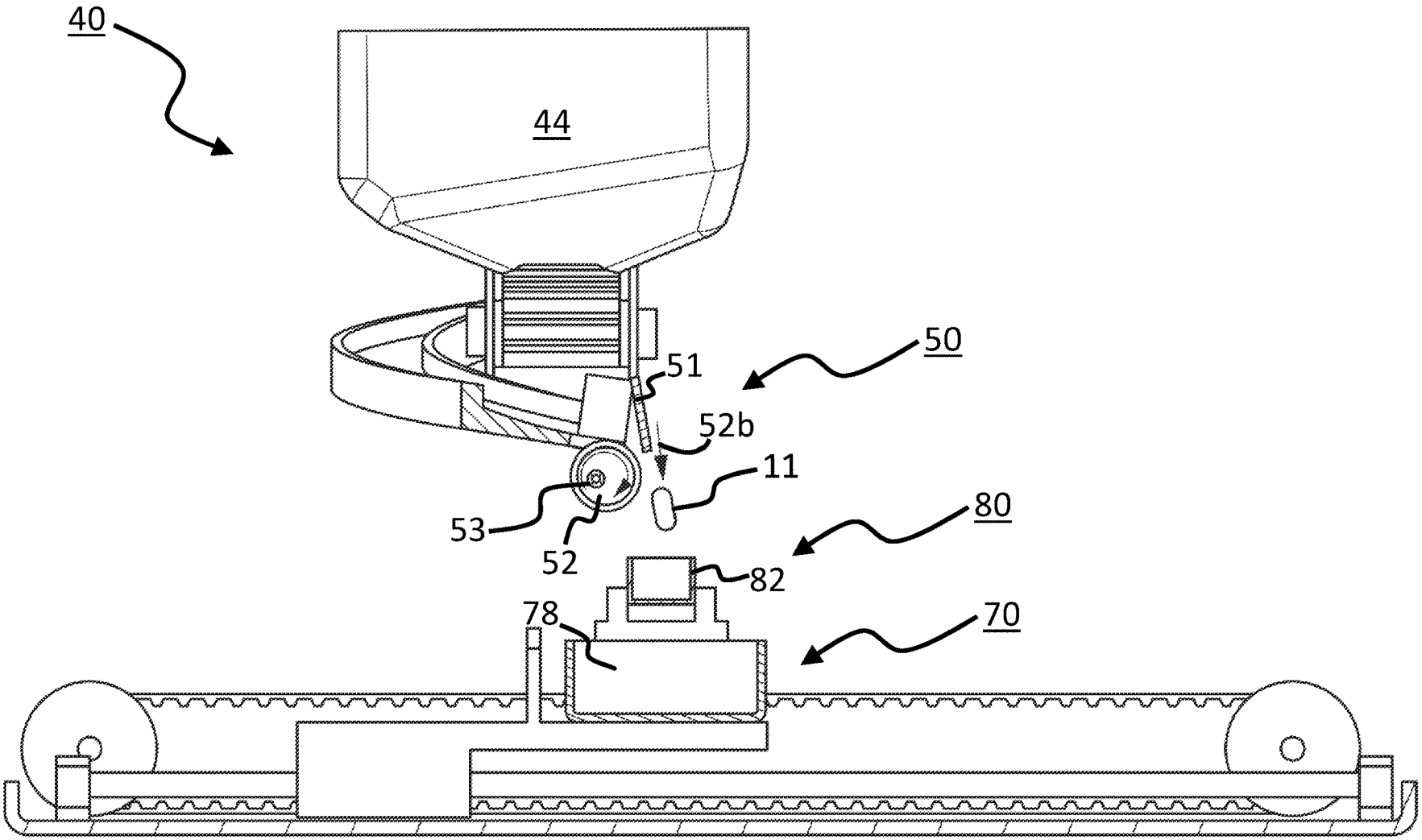
Figure 5G:
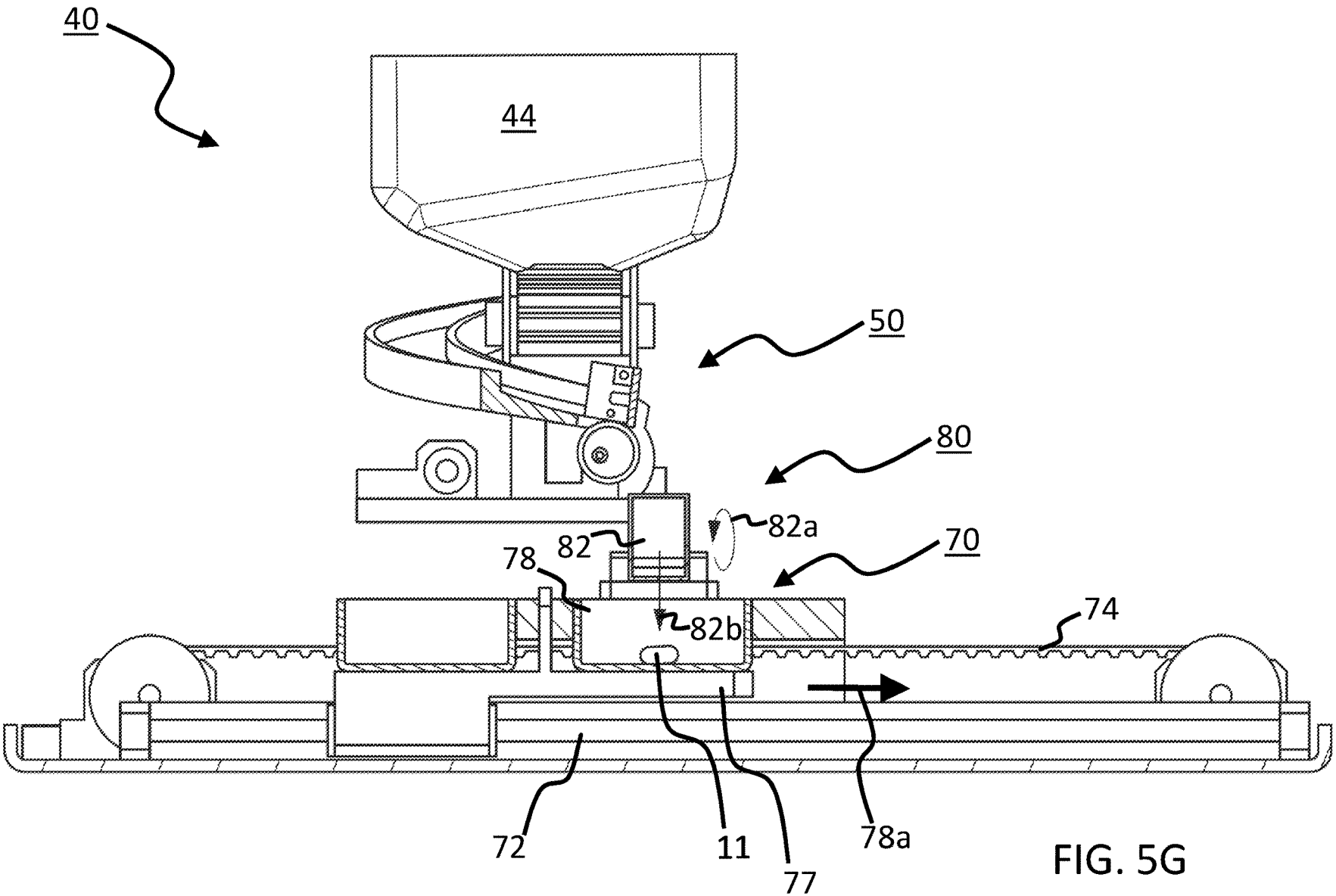

In FIG. 5D, an arrow 52*b* indicates where the pill 11 would be moving to as the cam 52 continues still further rotation in the same direction as indicated by arrow 52*a*. FIG. 5E continues the rotation of cam 52 such that the larger part thereof has moved mostly past the slot 48*d* and the pill 11 has thus moved off the cam 52, dis-engaging from surface 54. The pill 11 then falls off in direction 52*b*. The door 51*b* is also shown closing moving in the direction 51*b*. FIG. 5F includes the same relative positions of the cam 52, pill 11 and door 51, though further includes the scale cup 82 of scale sub-assembly 80 into which the pill 11 is shown being deposited. The scale then confirms the proper weight, as would be expected from the particular pill 11. If the weight is not as expected, too little or too much (if the pill is either not delivered or a larger or smaller than expected pill, or even if multiple pills are un-expectedly delivered), then the process is halted and re-set to have a different new pill delivered. If the proper weight is achieved, then, as shown in FIG. 5G, the scale cup 82 is rotated forward (see arrow 82*a*) to deliver the pill 11 (see arrow 82*b*) to the output delivery cup 78.

Then, further operation of the output cup subassembly 70 as shown in this implementation in FIG. 5F may include an output cup 78 mounted to a linear slide or base element 77 shown here disposed on and movable relative to one or more rails 72 powered by a motor 76 (not shown FIG. 5F, but, see FIG. 2). The slide element 77 and cup 78 can then be moved (see direction indicated by arrow 78*a*) by the conveyor belt 74 to which the slide element/base 77 is operationally attached. This motion may be computer controlled to deliver the pill(s) 11 to the user when desired and/or required (see FIG. 1C). A reverse motion (opposite of the direction of arrow 78*a*) can then be used to move the pill cup 78 back to receive another one or more further pills 11 for ultimate delivery to a user.

An optional sensor sub-assembly 90 may include one or more sensor(s) 91 as shown in FIG. 4D. One or more sensors 91 may be used to determine whether a pill 11 is at the known location 48*c*. The sensors may be of an optical sensor transmissive/slotted interrupter style or otherwise.

For the full cycle then, returning briefly first to FIGS. 1B and 2, the pill loading port 25 (FIG. 2) accessed by door or shutter 15 (FIG. 1B) located at the top of the pill dispenser 10 is/are opened to and do receive the pills 11 for operational manipulation as described herein. In one or more implementations, this port may be operated by or include a computer controlled shutter, see shutter/door 15 in FIG. 1 and shutter 27 in FIG. 2 (which may be additional to and operation with shutter 15, or may be in lieu of shutter 15), which may be configured to open to allow the user to pour one or more pills into a pre-selected storage bin 44; pre-selected having a variety of optional meanings, whether pre-selected by a user, or by a computerized selection process, or perhaps even in manufacturing, as for example when perhaps only a single bin might be included. In many implementations, the system and/or shutter may be configured so that the shutter 27 (FIG. 2, if used) may be opened when some criteria, as for example, the name, dosage and/or manufacturer of the prescription or over the counter pill has been confirmed by the user. Similarly, the system may be computer controlled to deliver through the processes described herein, one or more pills to output 17 via cup 78 or 18 as shown for example in FIG. 1C.

Figure 6:
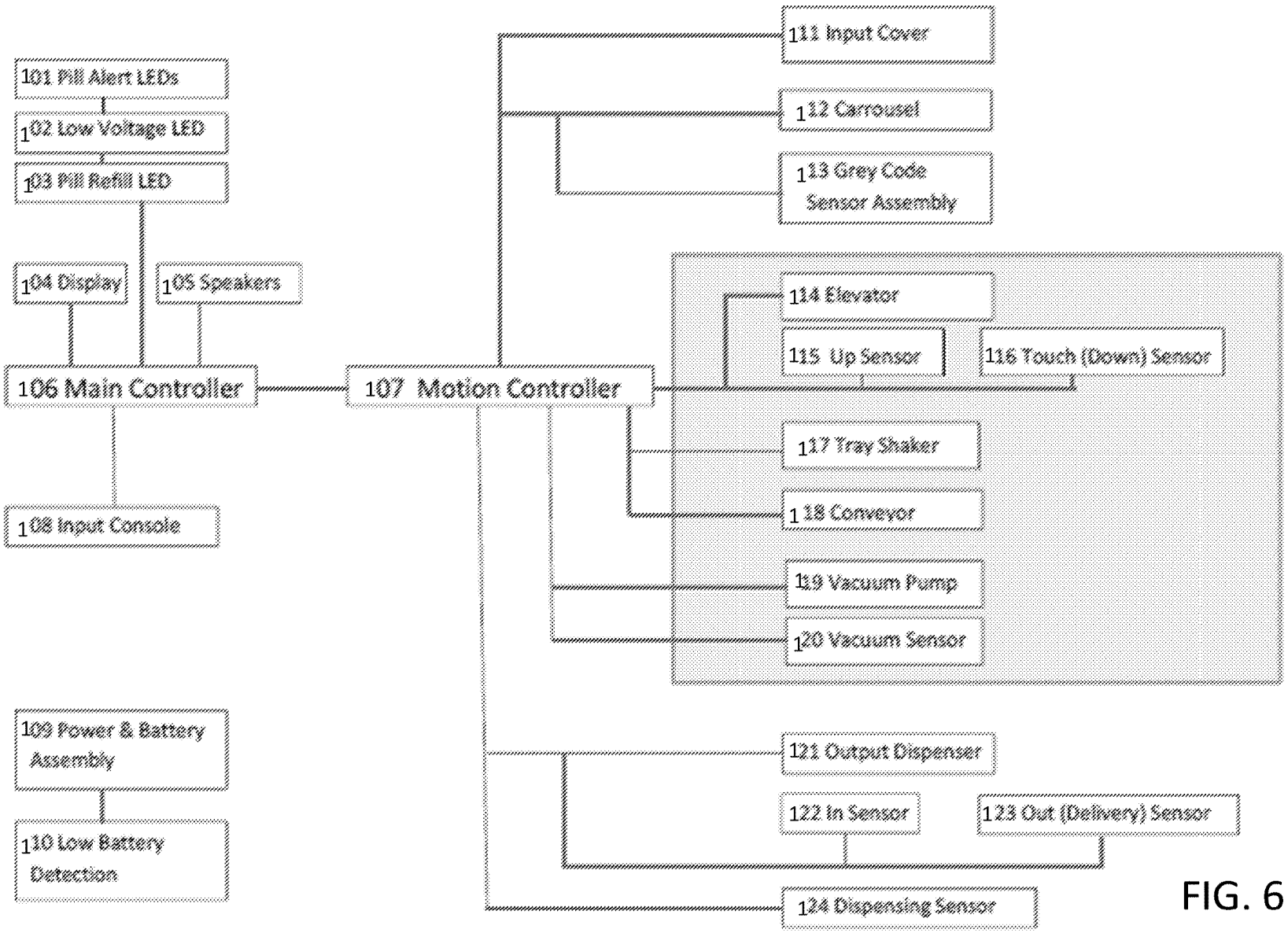
FIG. 6 is a block diagram of an electronics control combination or system according hereto; and, FIG. 7 is a block diagram of a combination or system or method according hereto.

FIG. 6 provides an electrical control system diagram that shows an implementation of a construction of some one or more circuits or combinations of one or more modules for possible use with/in the subject matter hereof. Although there are numerous ways a circuit may be designed to achieve a particular function or objective, some implementations herein/hereof may utilize one or more microprocessors and/or other circuit and/or other computer hardware. For a non-limiting example as shown in FIG. 6, a CPU board 106 may be employed as a main controller for the pill dispenser. A motion control circuit board 107 may also be used to provide the control circuitry and interface with the CPU board 106. Additional driver circuits or modules may also be included to energize each motor and read each sensor. The functions and interactions of motor driver circuits and sensor outputs are described below.

In FIG. 6 other modules may include the Power and Battery Assembly 109 which may include an AC cord and plug for use with a standard wall outlet, an AC/DC transformer for supplying the proper DC voltages and may include a battery such as a 5 Volt DC battery. A low DC voltage detection circuitry 110 may be included to monitor routinely or at designated times or constantly the DC power to the CPU board and directly to other circuits. A low voltage condition will, when/if used, be detected and cause activation of a Low Voltage LED 102 and in some implementations may be configured to send an automatic message to the user and/or one or more third parties via internet or otherwise.

To initialize use of pill dispenser 10 hereof, or an alternative method with alternative devices, the user may first be disposed to connect to a power source, as for example, to attach the device to a standard U.S. power outlet (110V, AC). This may also charge the back-up battery, if used, as needed. If the needed voltage of the dispenser deteriorates to a level that will no longer meet the power requirements of the pill dispenser 10, low power detection circuitry 110 may activate notifications to the user, caregivers and/or third parties as indicated in the SETUP files as may be configured by the user or a designee.

A pill refill LED 103 may be used and may be set by software routines which may indicate the quantity of pills in each pill storage bin 44. The specific pill(s) needing to be refilled may be indicated on the touch screen display 104 (or 14, FIG. 1A). Such software routines are explained below.

A set of User Alert LEDs 101 may be used and may be activated per a programmed timer in conjunction with a User Request command for pill dispensing. If the user has not activated the User Request command prior to the programmed pill taking time period, one or more User Alert LEDs 101 may be disposed to actively provide a visual alarm. When the visual alarm is active, and/or as an alternative to a visual alarm, an audio alarm may be used, in some examples an MP3 (audio) file may also be played through the Speakers 105 providing a simultaneous and/or alternative audio alarm.

During the pill dispensing period, a display 104 (and/or 14 as shown in FIG. 1A) operatively connected to the main controller 106, may in some implementations be configured to display one or more of the following: an image of each pill being dispensed, the total number of pills being dispensed, and any special instructions associated with any of the pills being dispensed.

An input console 108 may be included and may utilize a keyboard (see e.g., buttons 13, FIG. 1A), camera, microphone or touchscreen (see e.g., screen 14, FIG. 1A), either attached or disposed in the housing 12, or connected by cable or Bluetooth connection. Such an input console may be used by the User or their designee to enter data as described in the operation below.

The Motion Controller 107 may be used to provide control to motor driver circuits for running the DC motors and similar motors and/or reading the optical sensors to provide functionality for the pill dispenser 10. Further alternatives may include a clock, in some implementations a continuous running clock, in and/or otherwise associated with the Main Controller 106. Such a clock may be used to trigger one or more commands in the Motion Controller 107 that activate control circuits to activate the motors and read sensors as follows.

Pills 11 may initially be entered into the pill dispenser 10 through a shuttered opening 15 on the top of the pill dispenser 10 (as shown in FIG. 1). Initial information may be provided that specifically identifies each pill medication 11 to be entered. Following identification of the pills 11 immediately being entered, the Input Shutter 15 may be activated to slide back or open to reveal the opening for pouring in the pills 11. The Input Shutter 15 may then be activated to close when the pills are completely inserted; in some implementations, a user communication of this completion may be by pressing a button and/or may include entry of the pill count of the number of pills 11 inserted. Note, shutter 27 of FIG. 2 may be in lieu of or in addition to shutter 15, operable together therewith or separately.

A programmed timetable or other interval for delivery may be generated and used, or other demand instructions may be used. When a specific pill 11 is requested whether per a programmed timetable, or upon other appropriate command, the movable sub-assembly 30, which has attached thereto all of the pill storage bins 44, may then be rotated into the desired specific pill drop off position corresponding to whichever pill is to be delivered. The positioning information for this rotation may be achieved using optical sensors 35 specifically positioned to ensure that only a single sensor changes state during the rotation. This may provide an unambiguous, fixed number of discreet positions (whether 1, 2, 4, 8, 16 or otherwise herebetween or hereabove). Each position may be uniquely identified by a single Gray Code (though incremental or binary or other encoding options could be used in addition or instead). (See example of a Gray Code Table 1 set forth herebelow; three bit rotary coding for eight positions; though other variables are available, e.g., 2 or 4 positions, or 16 positions, et cetera.)

TABLE 1

Gray Coding

| Sector | Contact 1 | Contact 2 | Contact 3 | Angle |
|---|---|---|---|---|
| 0 | off | off | off | 0° to 45° |
| 1 | off | off | ON | 45° to 90° |
| 2 | off | ON | ON | 90° to 135° |
| 3 | off | ON | off | 135° to 180° |
| 4 | ON | ON | off | 180° to 225° |
| 5 | ON | ON | ON | 225° to 270° |
| 6 | ON | off | ON | 270° to 315° |
| 7 | ON | off | off | 315° to 360° |

Figure 8:
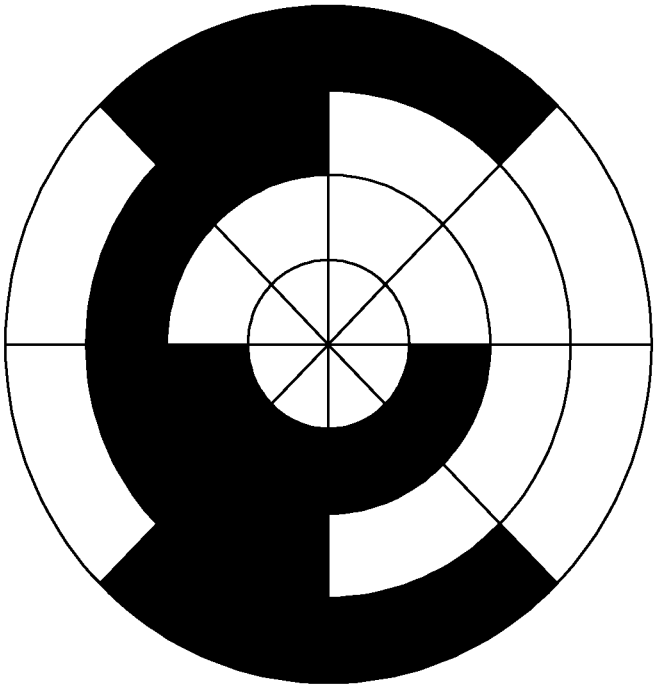
FIG. 8 is a gray code representation corresponding to Table 1.

(Rotary encoder for angle-measuring devices marked in 3-bit binary as shown in Table 1 and FIG. 8. The inner ring corresponds to Contact 1 in the table, Table 1. Black sectors in FIG. 8 are "on". Zero degrees is on the right-hand side in FIG. 8, with angle increasing counterclockwise.)

After the movable sub-assembly 30 has reached the pill drop off position, the respective conveyor 46, if used, is activated to move one or more pills from bin 44 to the respective chute or slide 48, if used, to get the pill to the known location 48*c*. The respective electric vibrator 49, if used, may be activated causing the pills to align within the pill trough 48 so that one pill 11 is in the known location directly over the moveable cam 52. The cam 52 may be activated to rotate, at a controlled speed, until the cam positioning sensor 91, if used, changes state thereby indicating the cam may have rotated sufficiently to cause a single pill 11 to move off the end of the pill trough 48.

With the pill storage and gate assembly 50 having the cam 52 thereof rotated to a position for the pill 11 to be over the scale cup 82 and/or the respective output dispenser cup 78 (in some implementations, the cam 52 may deliver directly to an output cup 78), the pill is moved by the cam 52 off the end of the trough 48 and allowed to fall by gravity into the scale cup 82 or output dispensing cup 78.

Depending on the number of pills 11 contained in the pill trough 48, the conveyor belt subassembly 46 may be activated to refill the pill trough 48 with one or more pills 11. An electric motor 62 may be used to rotate the conveyor belt subassembly 46 to the required position.

The movable sub-assemblage 30 may then be moved, as needed or desired, to the next position for the storage and gate assembly 50 to allow additional pills 11 to be dropped into the output cup 78 per the preprogrammed timetable or other appropriate demand initiation.

After the final pill 11 has been loaded/dropped into the output cup 48 for a particular pill taking period, the output dispensing cup 78 may then be moved into position for delivery of the pills 11 to the user. The output dispenser cup motor 76 may be activated which moves the output dispensing cup 78, mounted on a slide assembly 77, to a position external to the footprint of the pill dispenser 10. The motion may be stopped in some implementations when either a Move Out (Delivery) Sensor (not shown), if used, is tripped, or some other initiating indicator is activated. The pills 11 may then be manually removed from the output dispensing cup 78 by tipping the non-removable cup 18.

A dispensing sensor (not shown) may be used and may hereby change state to indicate the output dispensing cup 78 has been turned sufficiently to remove or other indication is made that all pills 11 are taken therefrom. When such a sensor returns to its initial state, indicating the pills have been removed, the linear slide assembly 77 may be configured to retract until a Move In (Return) Sensor (not shown), if used, or other indicating signal production indicates the end of travel.

Figure 7:
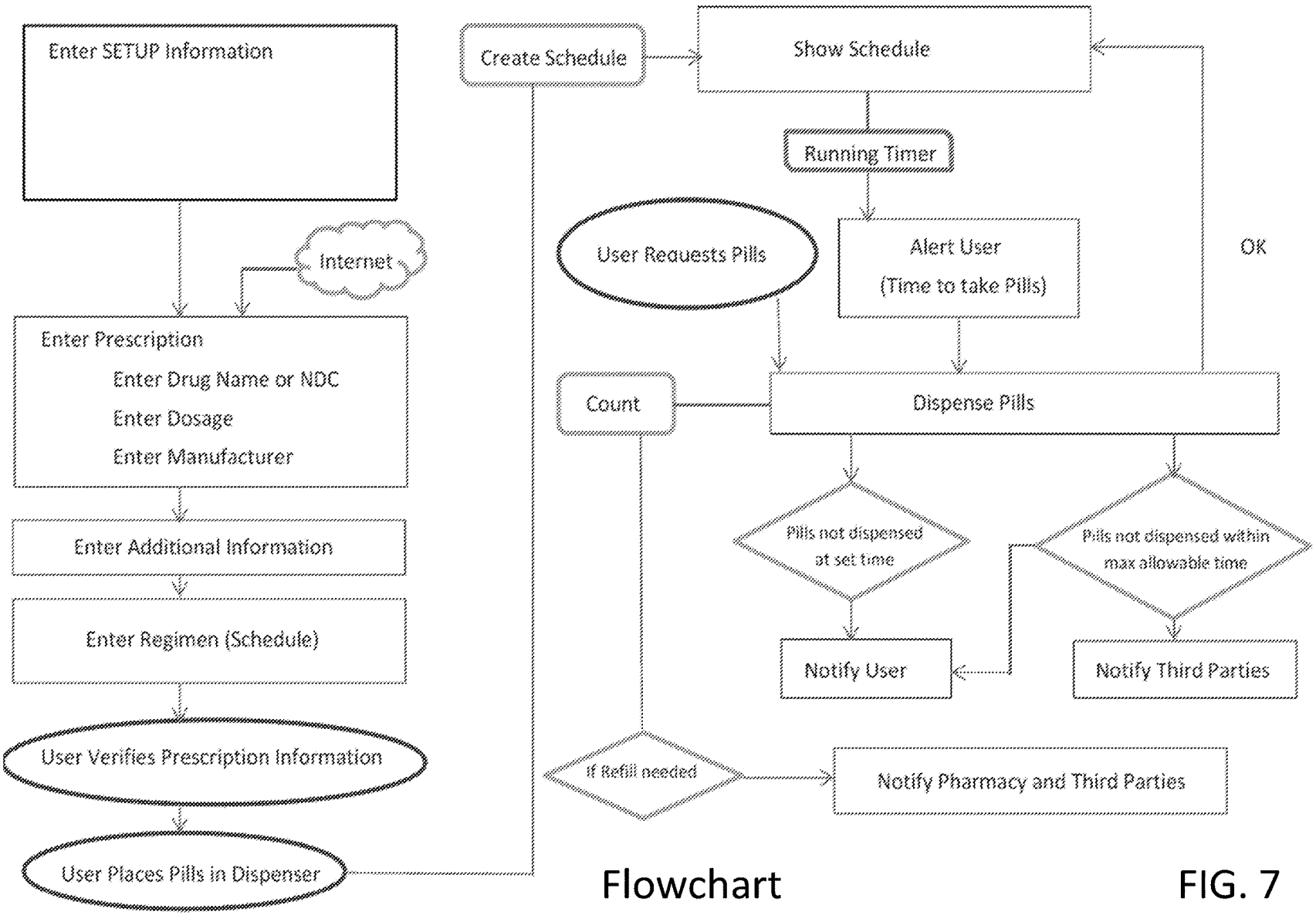

There are numerous ways to program a particular function or objective. In an exemplar implementation, an Android™ operating system implementation may be used, but other OS programs could be utilized. A diagram of exemplar software architecture is shown in FIG. 7.

The operation and an exemplar software flow may be as follows.

The user or their designee may initialize use of the system by selecting an initiating command, such as SETUP, from the main menu. The user sets initial information which may include one or more of the language of choice, the user's name, user's mobile information, the email address or addresses or other contacts for third party notifications, the remote account name and the remote access password.

The user may then set parameters such as for the duration of each alert to the user to take pills, the time span of continuing alerts (snooze control) for each pill taking time period and the time delay before notifying one or more third parties, such as caregivers or medical professionals, that pills have not been requested or removed from the dispensing cup.

The user may then enter a time of day for each pill taking periods of in some examples, Pre-Breakfast, Breakfast, Lunch, Dinner and Bedtime or accept the default times provided. Additional pill taking periods within the day may also or alternatively be named and added.

The system after being initialized may contain some one or more or all of the following information:

Display Language
User's name
User's email address
User's cellphone number
User's GRAMedical device passCODE
User's GRAMedical device passWORD
Recipient(s) (i.e. caregiver) email address(es)
Recipient(s) cellphone number(s)
Delay for Recipient Notification (in minutes)
Initial Alert Active Period (in seconds)
Alert Wait (Snooze) Period (in minutes)
Time Period Information:
- Pre-Breakfast (default 7:30 am)
- Breakfast (default 8:00 am)
- Lunch (default 12:00 pm)
- Dinner (default 5:30 pm)
- Bedtime (default 10:00 pm)

The setup routine may be edited at any time.

Following the system setup as described above, the drug and supplement information may be entered.

The user may initiate a program for loading pills 11 by selecting the icon, such as "Rx" on the display 104. Each container bin 44, each generally for discrete pills 11, may then be loaded as follows: pill name or National Drug Code (NDC) is entered, the correct dosage of the pill 11 may be identified from a pop-up menu list of options, and the manufacturer may be selected from a pop-up menu list of manufacturers. The drug or supplement may be entered into the initial drug entry screen by utilizing one of the available input methods. This implementation may contain databases from the U.S. Food and Drug Administration (FDA) and the National Institute of Health (NIH), or other national or international database, which may be part of an initial load of software. The databases may be maintained automatically as new data becomes available from the FDA and/or the NIH and/or other national or international database. The drugs may be entered via their National Drug Code (NDC) which may uniquely identify its name/manufacturer/strength or by first entering the drug name.

When the NDC code is not used for initially identifying the pill 11, the name of the drug may be searched as a drop down menu of all drugs which may be configured to appear as each additional letter of the drug's name is entered. The User may then select the drug from a drop down menu list that exactly matches the prescription. Supplement names are entered manually. Following the entry of a drug name, the next screen may contain a drop down menu list of all available doses of the prescription or over-the-counter FDA approved drug. Dosage (strength) information may only be entered manually for supplements. Following the selection of the dosage, the next screen may provide a drop down menu list of all manufacturers for the entered pill in the dosage selected. The manufacturer of the supplement may be configured to only be entered manually.

When a pill 11 has been entered which meets the identification criteria, it may be configured that an image, photograph or description of the pill 11 or OTC (Over the Counter) drug is shown graphically or in text, if available, on the dispenser's display 104 or 14. In some implementation such information may be obtained from and/or providing the pill dispenser 10 is connected to the internet. Following the image or description or other identification of the pill 11, the user may acknowledge the pill 11 is correctly identified and then a loading shutter 15 and/or 27 may automatically be repositioned (opened) to allow pouring the pills 11 from their original container into the pill dispenser 10. The pills 11 will be directed into a predetermined storage bin 44. There is typically one storage bin 44 and corresponding storage and gate assembly 50 for each unique set of pills 11 (see e.g., discrete pill handling assemblies 40*a*, 40*b*, 40*c* and 40*d* inter alia from FIG. 2).

After loading one particular set or at some point during loading or after loading each set of unique pills 11 in the pill dispenser 10, the user may enter the regimen (schedule) per instructions provided with the prescription or supplement.

A set of display pages may be provided for viewing on the display 14/104 to deal with entering the regimen (schedule). The user can select from several options for the type of time period in which the drug is taken; non-limiting examples including:

On Going (daily or cyclical days)

Limited Period (start and end date)

As Needed (with optional restrictions on frequency)

After setting the regimen, the user may enter additional information such as the name of the prescribing doctor, the doctor's contact information, the reason for taking the medication and/or special instructions given for taking or handling the medication. Additional information may also be entered as follows:

Rx Prescription Number

Pharmacy

Pharmacy Contact Information

In the case of non-solid or non-oral medications, the device may me employed to only act as a reminder and may not typically be used to store or dispense the supplement or drug. The user may indicate if the form of the supplement is a solid oral medication for the correct handling of the medication. Following the entry of all information regarding the medication, the data may be stored in a local database and a schedule for the next set number of days is created. In one implementation, the schedule may be displayed as the home page of the pill dispenser 10. The user may have optional views of the schedule in durations of the current day (today), some number of days into the future from today or some number of days prior to today.

The procedure may be repeated for each unique set of pills and as new pills are added for medical purposes.

When the pill loading and regimens have been entered, the pill dispenser 10 may then be ready for use.

To begin use of the pill dispenser 10, a pill dispensing icon on the display 104/14 may be touched to activate the pill gathering cycle required to load the dispensing cup 78 for the next pill taking time period. The one or more pills 11 may then be dispensed. In this manner, the pill or pills 11 can be dispensed either a short time prior to the programmed first alert or a limited period of time after the first alert. Multiple alerts may be given during the full alert period of each pill taking time period. If the pill dispensing icon has not been activated within a preset time from the first alert, the dispenser may be configured to send an alert to the personal mobile device of the user. If the pill dispensing icon has not been activated within the time parameter for an optional caregiver notification, the dispenser may be configured to send a notification to one or more caregivers and/or medical professionals to investigate the situation.

The pill counter memory, a part of the microprocessor or CPU board 106, may be used to track pill count and may be reduced for each pill dispensed based on the number of pills that have been dispensed. When the number of pills falls below a preset limit, the dispenser may be configured to send a notification whether via the internet or other methods or devices or systems to the user or specified pharmacy and/or one or more other third parties. An LED 102 may also be activated on the unit to indicate, to the User, that a refill is needed and/or expected for at least one dispensable medication.

Software routines may be used to count each pill 11 as they are dispensed. The device 10 may maintain quantity information for each pill type and can then provide refill information. The pill dispenser 10 may continue to automatically dispense the needed pills 11 to the pill taker as long as it contains the necessary quantity of pills 11 and power is applied, whether from the AC source or the back-up battery.

If the user has not initiated a request for pill dispensing, as the actual time of day reaches the start of a pill taking period for which pills or supplements are available, visual and/or audio alerts may in some implementations be issued by the device. Some configurations may provide for alerts to be simultaneously or otherwise activated in devices in other locations or rooms.

If the User has not initiated a request for pills to be dispensed within a preset time period after the initial alert (wait time), a notification may be sent to the User's personal remote device and may be done so repeatedly over a particular time period. The User may selectively turn off all notifications for a limited amount of time. If the User has not requested the pills past a maximum allowable time, the User and/or one or more or all third parties may receive notification via the internet or other communication methods.

The removal of the pills 11 from the dispensing cup 78/18 may include actuation of a sensor or other indicator that will initiate return of the dispensing dispensing cup and in some configurations also store the time and list of pills that were dispensed. This database of pills dispensed may be stored on the device and in some cases copied in a remote data storage device for secure access by caregivers or medical professionals.

At the time the dispensing cup 78/18 has been moved into its dispensing position, the display may configured to indicate all relevant special instructions for one or more of the pills 11 being dispensed.

The dispenser may continue to operate in the manner described above for each successive pill taking time for which one or more pills 11 are available and required or desired for the user.

As seen from the preceding description, the dispenser may in some implementations involve an electromechanical system that can be programmed and loaded with the proper pill(s) so that the proper pill(s) in the proper quantity can be dispensed at the desired time(s) with in some cases an alert signal for the pill taker. In addition to the alert, the pill taker may in some situations be provided additional information as necessary or desired to take the pills as advised by the prescribing doctor or medical advisor or otherwise.

The system may also provide for alerting a caregiver or medical professional when scheduled pills are not taken by the user or when there is a problem in the operation of the dispenser. One of the main advantages of a pill dispenser such as this may be in the ability for reminding the User to take their medication in a timely manner and removing the manual dispensing of pills into compartments related to fixed pill taking periods. Additionally, pill schedules and dosages can be changed by user or by computer input, either or both locally or remotely.

The system advantages may, though need not necessarily, include one or more of the following:

1. Verifying with the use of FDA (Food & Drug Administration) and NIH (National Institute of Health) or other national or international databases that each specific group of same pills 11 is loaded into a pill storage bin designated by the pill dispenser 10 for that particular pill 11;
2. Issuing a visual and/or audible alarm to alert the pill taker to remove the pill(s) from the non-removable, extended dispensing cup;
3. Displaying any special instructions for taking the dispensed pills per the prescribing doctor's orders;
4. Obtaining the proper quantity of each pill on a single pill basis for dispensing per user programmed input;
5. Storing all medication in a secure, locked manner;
6. Sending notifications to the third parties, such as caregivers and medical professionals, when dispensed pills have not been removed from the device;
7. Sending reminders to third parties, such as caregivers and pharmacies, when refills of prescriptions or supplements are needed or expected;
8. Allow changes to the pill regimen (schedule) or quantity to be dispensed remotely via internet enabled device; and
9. Insure safe, continuous operation including a battery back-up power system.

The system may also in some implementations include a locking mechanism to prevent unauthorized changes to the programming or removal of medication.

Accordingly, an aspect of the presently-described subject matter may, though not necessarily include providing an improved programmable automatic pill dispenser without the deficiencies and disadvantages of previous pill dispensing devices; specifically, to provide a simple and reliable programmable automatic pill dispenser that has one or more of the ability to provide each pill, as needed or desired, having been confirmed to match the prescription at time of loading, is dispensed per preset time(s), has a locking mechanism for security, and/or provides the necessary additional instructions during the dispensing to the user.

Still further objects and advantages may, though not necessarily, include one or more of:

a) providing a programmable automated pill dispenser that is capable of verifying the actual pill medication being loaded prior to placement in the device;
b) providing a programmable automated pill dispenser that has a system to select individual pills for dispensing per a programmable time table;
c) providing a programmable automated pill dispenser with the capability of storing pills in a secure manner;
d) providing displaying of special instructions or messages associated with corresponding pills during the dispensing process;
e) providing a programmable automated pill dispenser with capability of alerting the user by visual and audio alarms to pill taking periods;
f) providing alerting of or to a third party, such as a caregiver or medical professional, when pills have not been dispensed, quantities stored are low or the device is malfunctioning;
g) providing for notifying a third party, such as a pharmacy, when quantity is low in regards to planned dispensing over a pre-set amount of time;
h) providing a programmable automatic pill dispenser that is simple to use, compact, and reliable including back-up battery operation,
i) providing a programmable automated pill dispenser with a pill storage arrangement that can be easily removed as needed for medical and/or cleaning purposes,
j) providing a method of changing the pill quantity or schedule remotely via secure internet access,
k) providing a user initiated command for dispensing pills on an as needed basis;
l) providing a programmable automated pill dispenser that reduces the possibility of the pill taker taking an improper accumulation of dispensed pills which may result in an overdose;
m) providing software controls that prevent dispensing pills in such a way as to avoid an overdose.

Some other advantages of a dispenser hereof may, though not necessarily, include one or more of:

a) Pill storage bins which may be rotated for simple loading of the pills and as needed for the dispensing of pill(s);
b) Automated, non-removable, dispensing cup for simple dispensing to the user;
c) Pill dispensing software which may prevent an accumulation of dispensed pills to eliminate the possibility of overdosing caused by the dispenser;

d) Refill tracking software which may provide messages to caregivers or pharmacies as needed for refills;

e) Remote setting of dispensing instructions via internet;

f) Remote setting of refill instructions for refilling storage bins.

The possible variations and ramifications of the present developments may be numerous. For example, additional levels of storage and gate assemblies can be added to increase the number of unique pills serviced by the pill dispenser.

Another variation may be to remove the need for manual entry of pill information into the device by including a bar code reader for prescription and supplemental drug related information. Another variation may employ a voice recognition system or communication with or through the internet or other communication line for data stored with each pill.

Other ramifications and variations of the basic concept which have not been described will be apparent to those skilled in the art. It is intended that all such ramifications and variations be included within the scope of the appended claims and their legal equivalents, and the scope of the invention not be limited by the examples given, or the claims hereof.

Clauses

A method may be included herein for automatically dispensing a verified, preselected pill and alerting a user to take said preselected pill at a preset time, comprising:

a. verification of pill identity with FDA/NIH databases;

b. avoiding unrecognized pill loading;

c. providing a programmable time table for presetting pill taking time periods;

d. programming said time table to transmit a signal at said preset time;

e. providing a method of input for pill data including one or more of Name of Doctor, Reason for Taking Medication, Contact Information for Doctor, Contact Information for Caregiver;

f. providing a series of movable storage and gate assemblies of pill storage compartments, each compartment of series being movable to a position for the extraction of a single pill;

g. a mechanical cam assembly that can remove a single pill from a preselected storage and gate assembly;

h. discharging a single pill by gravity from the end of a pill trough into a dispensing cup;

i. providing an actuator for automatically moving said storage and gate assembly into position with said dispensing cup assembly in response to signal from a user or programmable time table;

j. providing an audio and visual alarm to alert said user to take the pill(s) that is contained in the dispensing cup;

k. providing a message to a remote person such as a caregiver or medical professional regarding user's pill taking compliance;

l. providing a message to a remote person such as a caregiver or medical professional regarding the pill inventory status;

m. providing for continuous operation in the event of AC power failure;

n. providing for changing parameters related to the pill quantity and/or schedule by local or remote computer access;

o. providing storage of medications in a secure manner.

Alternatively included may be a web-enabled device that can be loaded with appropriate pills (solid oral medication) and programmed to automatically dispense the proper quantity of the proper type(s) of pill(s) at the proper time(s) each day. The device may include the following systems:

- System for identifying pills prior to storage
  - Pills can be identified by name or National Drug Code (NDC)
- System for storing pills
  - Identified pills are placed in the device and stored for later dispensing
- System for handling pills on an individual basis for dispensing (multiple implementations)
  - Device is capable of dispensing pills in required quantities
- System for programming pill schedules (regimens)
  - Times can be set to dispense pills throughout each day
- System for remote programming
  - Password protected system allows remote changes to schedule (regimen) via internet web based and/or smart device
  - Password protected system allows remote setup of system for proper refilling by user
- System for alerting user
  - Users are alerted to pill disbursement time with visual and audio alarms
- System for notifying third-parties
  - Third parties, such as caregivers and medical staff, can be notified by text and other electronic messages when pills are not taken, unit malfunctions, or refills are needed
- System for electronic controls
  - Control electronics ensure pills are located and handled properly
- System for back-up power
  - Device remains functional if there is an AC power source failure
- Software controller with operating system Major components of the device may include, though not necessarily and not limited hereto: a rotary assembly 30 with storage and handling assemblies 40, mechanical cam and door or gate subassembly 50, a trough vibration shaker mechanism 49, storage bin and conveyor belt mechanism 44 and 46, control electronics 100-110, output dispensing cup assembly 70, scale assembly 80, back-up power storage assembly 107, LED based visual alert circuit 108, a WiFi internet connection system 109, and/or a 3G (and/or LTE) connection system 110.

Major process flow software components include may include, though not necessarily and not limited hereto: pill identification, prescription information data storage, programmable scheduling 113, user defined audio alert 114, cloud database storage capability 115, remote smart device application 116 and/or web-based device and database controls 117.

The components, whether of apparatus, system and/or method, described above are meant to exemplify some types of possibilities within the scope hereof. In no way should the aforementioned examples limit the scope of the invention and/or claimed subject matter, as they are only exemplary embodiments or implementations. While embodiments or implementations of the present invention and/or claimed subject matter relate to devices, systems, and/or methods, that have been described above, various alternatives, modifications, and equivalents will be apparent to those skilled in the art without varying from the spirit of the invention and/or claimed subject matter. Therefore, the above description should not be taken as limiting the scope of the invention or claimed subject matter, which is defined by the appended claims.

What is claimed is:

1. A pill dispensing method comprising:

picking up a pill with a pick-up member configured and disposed to pick up the pill directly at a known pill drop-off location directly at an end of a chute; including:

moving the pick-up member to alternately not be in contact with the pill at the known pill drop-off location at the end of the chute, and then be in contact with the pill at the known pill drop-off location at the end of a chute;

frictionally engaging the pill;

lifting the pill via continued frictional engagement of the pill at least partially upward off the end of the chute, and then moving the pill via continued frictional engagement of the pill to the known pill drop-off location;

the pick-up member being an off-center rotational pick-up member so that the rotational pick-up member is rotationally movable following the off-center disposition to alternately be not in contact with the pill at the known pill drop-off location, and then in contact with the pill at the known pill drop-off location, and then disposed to move the pill from the known pill drop-off location, wherein the end of the chute includes a cutout for entering of the pick-up member.

2. A method according to claim 1, the frictional engaging including one or the other or both of:

a rubberized surface, or an o-ring.

3. A pill dispensing method according to claim 1 further comprising:

a housing and a frame sub-assembly wherein:

the housing has:

a pill receiving opening, and, a pill delivery opening;

the frame sub-assembly has:

a base plate;

one or more arms; and a top portion;

the housing and the frame sub-assembly have openings for receiving one or more pills;

the housing and the frame sub-assembly have openings cooperative with a receiving bin for receiving one or more pills moved to the receiving bin; and, the housing and the frame sub-assembly have openings for receiving one or more pills, the openings having respective doors for closing the openings.

4. A pill dispensing method according to claim 1 further comprising:

an axle upon which a rotational pick-up member is disposed; the axle being rotatable and thereby imparting rotational motion to the rotational pick-up member; and an engaging surface disposed on the pick-up member; the engaging surface being configured to engage the pill at the known pill drop-off location to move the pill therefrom.

5. A pill dispensing method according to claim 1 further comprising:

an openable gate at the end of the chute defining the known pill drop-off location and the openable gate being operational to hold the pill at the known pill drop-off location.

6. A pill dispensing method according to claim 5 wherein the openable gate is configured to be operable:

with the rotational pick-up member to open for movement of the pill from the known pill drop-off location; and, discretely from the rotational pick-up member to open for movement of the pill from the known pill drop-off location.

7. A pill dispensing method according to claim 1 wherein the chute has a slot at the known pill drop-off location, the slot being operationally disposed relative to the rotational pick-up member for the rotational pick up member to move therein so that the rotational pick-up member is rotatable to alternately not be in contact with the pill at the known pill drop-off location, and then in contact with the pill at the known pill drop-off location, and then moving the pill from the known pill drop-off location.

8. A pill dispensing method according to claim 1:

wherein the chute is configured to move a pill from a pill receiving bin to the known pill drop-off location.

9. A pill dispensing method according to claim 1 further comprising a pill handling sub-assembly comprising:

a receiving bin for receiving and containing one or more pills until desired; and, a conveyor configured for moving one or more pills from the receiving bin to the chute.

10. A pill dispensing method according to claim 9 wherein:

delivering one or more pills from the receiving bin to the chute; and removing one or more pills from the receiving bin.

11. A pill dispensing method according to claim 1 further comprising a motor sub-assembly comprising:

a rotational pick-up member motor to engage and move the pick-up member; and, a conveyor motor to engage and move the conveyor.

12. A pill dispensing method according to claim 11 wherein:

the rotational pick-up motor is dis-engageably engageable with the rotational pick-up member;

the conveyor motor is dis-engageably engageable with the conveyor;

the rotational pick-up motor has a protruding part that is dis-engageably engageable with the rotational pick-up member;

the conveyor motor has a protruding part that is dis-engageably engable with the conveyor;

the rotational pick-up member has a pair of pins that are disposed to be dis-engageably engageable with the rotational pick-up motor; and, the conveyor has a pair of pins that are disposed to be dis-engageably engageable with the conveyor motor.

13. A pill dispensing method according to claim 1 further comprising:

a scale sub-assembly; and, a delivery sub-assembly;

both being configured to receive one or more pills from the rotational pick-up member.

14. A pill dispensing method according to claim 13 wherein:

the scale sub-assembly is configured to receive one or more pills from the rotational pick-up member;

the scale sub-assembly is configured to confirm the proper amount of one or more pills is delivered thereto by weight;

the scale sub-assembly is configured to deliver the one or more pills to the pill delivery sub-assembly;

the scale sub-assembly is configured to deliver the one or more pills to a user;

the delivery sub-assembly is configured to receive the one or more pills from the scale sub-assembly;

the delivery sub-assembly is configured to deliver the one or more pills to a user; and, the delivery sub-assembly has a pill delivery cup that is configured to receive the one or more pills from the scale sub-assembly; and, deliver the one or more pills to a user.

15. A pill dispensing method according to claim 1 further comprising a rotational sub-assembly connected to a frame sub-assembly, the rotational sub-assembly further comprising:

a rotational shaft connected to the frame sub-assembly;

a turntable connected to the rotational shaft; and, motion controller.

16. A pill dispensing method according to claim 15 wherein:

the pick-up member includes a plurality of pick-up members that are operationally disposed relative to one or both of the shaft and the turntable;

the known pill drop-off locations includes a plurality of combinations of respective known pill drop-off locations and the pick-up members are operationally disposed relative to one or both of the shaft and the turntable;

the chute includes a plurality of combinations of respective chutes and the plurality of pick-up members are operationally disposed relative to the shaft and the turntable;

a pill handling sub-assembly includes a plurality of combinations of respective pill handling sub-assemblies and the plurality of pick-up members are operationally disposed relative to the shaft and the turntable;

two discrete combinations of respective known pill drop-off locations and the plurality of pick-up members are operationally disposed relative to one or both of the shaft and the turntable;

the turntable is operable with the motion controller to determine relative position of the rotational sub-assembly; and the turntable has one or more ridges that are coactively disposed relative to a sensor array of the rotational sub-assembly to determine relative position of the rotational sub-assembly.

17. A pill dispensing method according to claim 1 further comprising a main controller connected to and controlling the pick-up member.

18. A pill dispensing method according to claim 17 wherein:

the main controller provides electrical signals to control the operation of the pick-up member;

the main controller provides electrical signals to a pick-up member motor to control the operation of the pick-up member motor to operate the pick-up member and control operation thereof;

the main controller provides electrical or electronic signals to control the operation of the gate at the known pill drop-off location;

the main controller provides electrical signals to a gate motor to control the operation of the gate motor to operate the gate and control operation thereof;

the main controller provides electrical signals to control the operation of a conveyor;

the main controller provides electrical signals to a conveyor motor to control the operation of the conveyor motor to operate the conveyor and control operation thereof;

the main controller provides electrical signals to control the operation of a vibrator;

the main controller provides electrical signals to a vibrator motor to control the operation of the vibrator motor to operate the vibrator and control operation thereof;

the main controller provides electrical signals to control the operation of a rotational sub-assembly;

the main controller provides electrical signals to a rotational sub-assembly motor to control the operation of the rotational sub-assembly motor to operate the rotational sub-assembly and control operation thereof;

the main controller provides electrical signals to control the operation of a scale sub-assembly;

the main controller provides electrical signals to a scale sub-assembly motor to control the operation of the scale sub-assembly motor to operate the scale sub-assembly and control operation thereof;

the main controller provides electrical signals to control the operation of a delivery sub-assembly;

the main controller provides electrical signals to a delivery sub-assembly motor to control the operation of the delivery sub-assembly motor to operate the delivery sub-assembly and control operation thereof;

the main controller provides electrical signals to control the operation of a pill receiving door opening and closing and delivery door opening and closing; and the main controller provides electrical signals to a motor for both the pill receiving door opening and closing and delivery door opening and closing to control the operation of the pill receiving door opening and closing and delivery door opening and closing to operate and dis-engageably engage the pill receiving door opening and closing and delivery door opening and closing and control operation thereof.

19. A pill dispensing method according to claim 1 further comprising a sensor sub-assembly; the sensor sub-assembly having at least one sensor disposed to sense one or more pills at a location.

20. A pill dispensing method according to claim 19 wherein:

the sensor sub-assembly provides a signal to the main controller that one or more pills are at the known pill drop-off location;

the sensor sub-assembly provides a signal to the main controller that one or more pills are in the chute;

the sensor sub-assembly provides a signal to the main controller that provides electrical signals to control the operation of the pick-up member; and the sensor sub-assembly provides a signal to the main controller that provides electrical signals to a pick-up member motor to control the operation of the pick-up member motor to operate the pick-up member and control operation thereof.

* * * * *